US011193229B2

(12) United States Patent
Ayers et al.

(10) Patent No.: US 11,193,229 B2
(45) Date of Patent: Dec. 7, 2021

(54) USER INTERFACE SOLUTIONS FOR ACCESSING APPLIANCE CONTROL THROUGH COSMETIC OUTER CABINET

(71) Applicant: WHIRLPOOL CORPORATION, Benton Harbor, MI (US)

(72) Inventors: Kevin B. Ayers, St. Joseph, MI (US); Seth E. Bixby, Stevensville, MI (US); Donald E. Erickson, Stevensville, MI (US); Eric A. Hill, Chicago, IL (US); Dennis Kehl, Benton Harbor, MI (US); Andrew C. Kubasiak, St. Joseph, MI (US); Sayer J. Murphy, St. Joseph, MI (US); Trevor R. Haney, Jenison, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 65 days.

(21) Appl. No.: 16/527,975

(22) Filed: Jul. 31, 2019

(65) Prior Publication Data

US 2020/0121158 A1 Apr. 23, 2020

Related U.S. Application Data

(60) Provisional application No. 62/747,933, filed on Oct. 19, 2018.

(51) Int. Cl.

| | |
|---|---|
| ***D06F 34/30*** | (2020.01) |
| ***D06F 39/14*** | (2006.01) |
| ***D06F 58/20*** | (2006.01) |
| ***A47L 15/42*** | (2006.01) |

(52) U.S. Cl.
CPC ..... *D06F 34/30* (2020.02); *A47L 15/4259* (2013.01); *A47L 15/4265* (2013.01);
(Continued)

(58) Field of Classification Search
CPC ..... D06F 34/28; D06F 34/30; D06F 39/14; D06F 58/20
See application file for complete search history.

(56) References Cited

U.S. PATENT DOCUMENTS

| | | | |
|---|---|---|---|
| 3,603,657 | A | 9/1971 | Hassay |
| 5,802,467 | A | 9/1998 | Salazar et al. |

(Continued)

FOREIGN PATENT DOCUMENTS

| | | |
|---|---|---|
| DE | 202006016113 | 4/2007 |
| DE | 102013208851 | 11/2014 |

(Continued)

OTHER PUBLICATIONS

WO2019007436A1 Machine Translation (Year: 2019).*

*Primary Examiner* — Spencer E. Bell
(74) *Attorney, Agent, or Firm* — Price Heneveld LLP

(57) ABSTRACT

A laundry appliance includes a body that houses a motor that selectively operates a drum for processing laundry, wherein the body includes an aperture for selectively accessing the drum. A door panel provides selective access to the aperture. A controller is configured to operate at least the motor. A user interface is in communication with the controller for selecting a laundry-processing operation to be performed. An outer panel at least partially conceals the body from view. An outer selector is positioned proximate the outer panel, wherein the outer selector is in communication with the controller via the user interface.

16 Claims, 28 Drawing Sheets

(52) U.S. Cl.
CPC ..... *A47L 15/4293* (2013.01); *D06F 39/14* (2013.01); *D06F 58/20* (2013.01)

(56) References Cited

U.S. PATENT DOCUMENTS

| | | | | |
|---|---|---|---|---|
| 6,600,397 | B2 | 7/2003 | Bassi | |
| 7,038,667 | B1 | 5/2006 | Vassallo et al. | |
| 7,347,460 | B2 | 3/2008 | Ala | |
| 8,606,180 | B2 | 12/2013 | Santinato et al. | |
| 8,844,831 | B2 | 9/2014 | Mullis et al. | |
| 8,911,563 | B2 | 12/2014 | Tiekoetter et al. | |
| 9,346,397 | B2 | 5/2016 | Gergets et al. | |
| 2010/0051072 | A1 | 3/2010 | Brambilla | |
| 2015/0015519 | A1* | 1/2015 | Scotto D'Apollonia | H05B 6/6435 345/173 |
| 2015/0315737 | A1* | 11/2015 | Yang | F21V 33/0044 362/23.04 |
| 2017/0137985 | A1* | 5/2017 | Kim | D06F 39/14 |
| 2018/0010287 | A1 | 1/2018 | Leisl, III et al. | |

FOREIGN PATENT DOCUMENTS

| | | | |
|---|---|---|---|
| DE | 102014007172 | 11/2015 | |
| EP | 0688102 | 12/1995 | |
| EP | 2868795 | 5/2015 | |
| EP | 3263758 | 1/2018 | |
| JP | 2956118 | 10/1999 | |
| WO | 2016105312 | 6/2016 | |
| WO | WO-2019007436 A1 * | 1/2019 | D06F 39/00 |

* cited by examiner

USER INTERFACE SOLUTIONS FOR ACCESSING APPLIANCE CONTROL THROUGH COSMETIC OUTER CABINET

CROSS-REFERENCE TO RELATED APPLICATION

This application claims priority to and the benefit under 35 U.S.C. § 119(e) of U.S. Provisional Patent Application No. 62/747,933, filed on Oct. 19, 2018, entitled USER INTERFACE SOLUTIONS FOR ACCESSING APPLIANCE CONTROL THROUGH COSMETIC OUTER CABINET, the entire disclosure of which is hereby incorporated herein by reference.

FIELD OF THE DEVICE

The device is in the field of controls for appliances, and more specifically, a control for an appliance that may be accessed through an outer cosmetic panel for activating or otherwise engaging a concealed user interface of the interior appliance.

SUMMARY

In at least one aspect, a laundry appliance includes a body that houses a motor that selectively operates a drum for processing laundry, wherein the body includes an aperture for selectively accessing the drum. A door panel provides selective access to the aperture. A controller is configured to operate at least the motor. A user interface is in communication with the controller for selecting a laundry-processing operation to be performed. An outer panel at least partially conceals the body from view. An outer selector is positioned proximate the outer panel, wherein the outer selector is in communication with the controller via the user interface.

According to another aspect of the present disclosure, a laundry appliance includes a body that houses a motor that selectively operates at least one of a drum and a blower for processing laundry within the drum. The body includes an aperture for selectively accessing the drum. A door panel provides selective access to the aperture. A user interface is in communication with a controller for selecting a laundry-processing function to be performed via operation of the motor. A cosmetic outer structure at least partially conceals the body from view. The cosmetic outer structure includes an outer panel and a top panel. An outer selector is positioned proximate the outer panel, wherein the outer selector is in communication with the controller via the user interface.

According to yet another aspect of the present disclosure, a laundry appliance includes a body that houses a motor that selectively operates at least one of a drum and a blower for processing laundry within the drum. The body includes an aperture for selectively accessing the drum. A door panel provides selective access to the aperture. A user interface is in communication with a controller for selecting a laundry-processing function to be performed via operation of the motor. A cosmetic outer structure at least partially conceals the body from view. The cosmetic outer structure includes an outer panel and a top panel. A gesture sensing region is defined proximate the outer panel. The gesture sensing region is configured to wirelessly interact with the user interface when an obstruction engages the gesture sensing region.

These and other features, advantages, and objects of the present device will be further understood and appreciated by those skilled in the art upon studying the following specification, claims, and appended drawings.

DETAILED DESCRIPTION OF EMBODIMENTS

Figure 1:
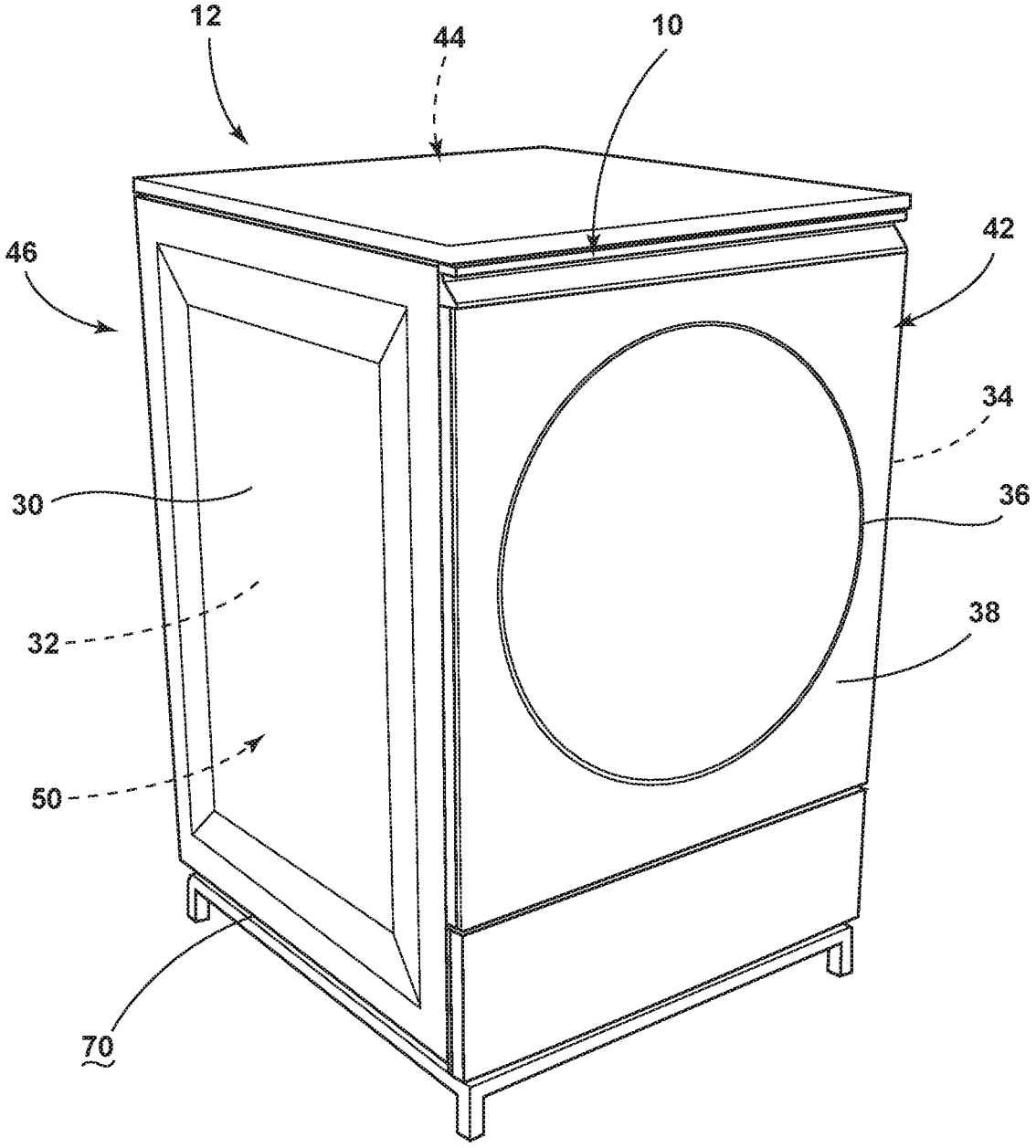
FIG. 1 is a front perspective view of a laundry appliance.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

With respect to FIGS. 1-38, reference numeral 10 generally refers to a user interface for an appliance 12 that is concealed within a cosmetic outer panel 14 or cosmetic outer structure 16. The presence of a cosmetic outer structure 16 for concealing an appliance 12 is used to provide an alternative aesthetic appearance for the appliance 12 to be similar to that of built-in cabinetry or other furniture and fixtures within a home. By concealing the appliance 12 or appliances 12 within the cosmetic outer structure 16, the appliances 12 can be positioned within various parts of the home that may not include a dedicated laundry room or other dedicated utility space. Because the cosmetic outer structure 16 is included, it may become desirable to access a user interface 10 for the appliance 12 without first opening the outer panel 14 for the cosmetic outer structure 16. To accomplish this, an intermediary interface 18 can be positioned within or around a portion of the cosmetic outer structure 16 for accessing the user interface 10 for a concealed appliance 12 in an expedient fashion, or at least without opening the outer panel 14 for the cosmetic outer structure 16.

Referring again to FIGS. 1-4 and 38, the appliance 12, which can include a laundry appliance 12, includes a body 30 that houses a motor 32 for selectively operating a drum 34 and a blower 50 for processing laundry. The body 30 typically includes an aperture 36 for selectively accessing a drum 34 through the body 30. A door panel 38 is attached to the body 30 and provides selective access to the aperture 36 when the door panel 38 is in an open position 40. In a closed position 42, the door panel 38 conceals the aperture 36 and prevents access to the drum 34 for the appliance 12. A controller 44 is configured to operate at least the motor 32, and also, typically, operates various dispensing mechanisms, fluid transfer mechanisms, filtering mechanisms, air flow mechanisms, heat exchangers, and other similar mechanical and electrical mechanisms within the appliance 12. The user interface 10 for the appliance 12 is in communication with the controller 44 for selecting an operating condition 46 for the appliance 12 to be performed at least by the motor 32. A cosmetic outer structure 16 that can include an outer panel 14 at least partially conceals the body 30, and the remainder of the appliance 12, from view. An outer selector 48, typically in the form of the intermediary interface 18, is positioned proximate the cosmetic outer structure 16. The outer selector 48 is in communication with the controller 44 via the user interface 10.

According to various aspects of the device, the intermediary interface 18 can include the outer selector 48 positioned on or within the cosmetic outer structure 16 and can be used for accessing the user interface 10 for the concealed appliance 12. In certain situations, it may become necessary to start, stop, pause, or otherwise modify an operating condition 46 for the appliance 12. The user may wish to access the user interface 10 without first opening the outer panel 14 for the cosmetic outer structure 16. The intermediary interface 18 that is incorporated within, or proximate, the cosmetic outer structure 16 allows the user to engage the cosmetic outer structure 16 to, in turn, directly or indirectly engage the user interface 10 for the appliance 12 for modifying an operating condition 46 for the concealed appliance 12.

By way of example, and not limitation, a user may begin a laundry treatment cycle for an appliance 12 that is concealed within a cosmetic outer structure 16. During the cycle, the user may desire to pause the operating condition 46 to wait for additional laundry or to allow another individual to access the appliance 12 and restart the operating condition 46. The intermediary interface 18 incorporated within the cosmetic outer structure 16 allows the user to engage the cosmetic outer structure 16 to operate the concealed appliance 12 without first opening the outer panel 14 for the cosmetic outer structure 16. Through the intermediary interface 18, the user can, at least, indirectly engage the user interface 10 for the concealed appliance 12.

In certain situations, time may be a factor for quickly pausing or stopping an operating condition 46 for the appliance 12. Such a condition may be a condition of severe imbalance, sounds of loose change or other undesirable items being located within the appliance 12, forgetting to add the proper laundry chemistry to the appliance 12, and other conditions that may present a condition to stop operation of the appliance 12 as soon as possible. Time saved by not having to open the outer panel 14 for the cosmetic outer structure 16 is desirable to prevent damage to the appliance 12 or clothing or, at minimum, prevention of an ineffective laundry cycle from being performed.

Figure 5:
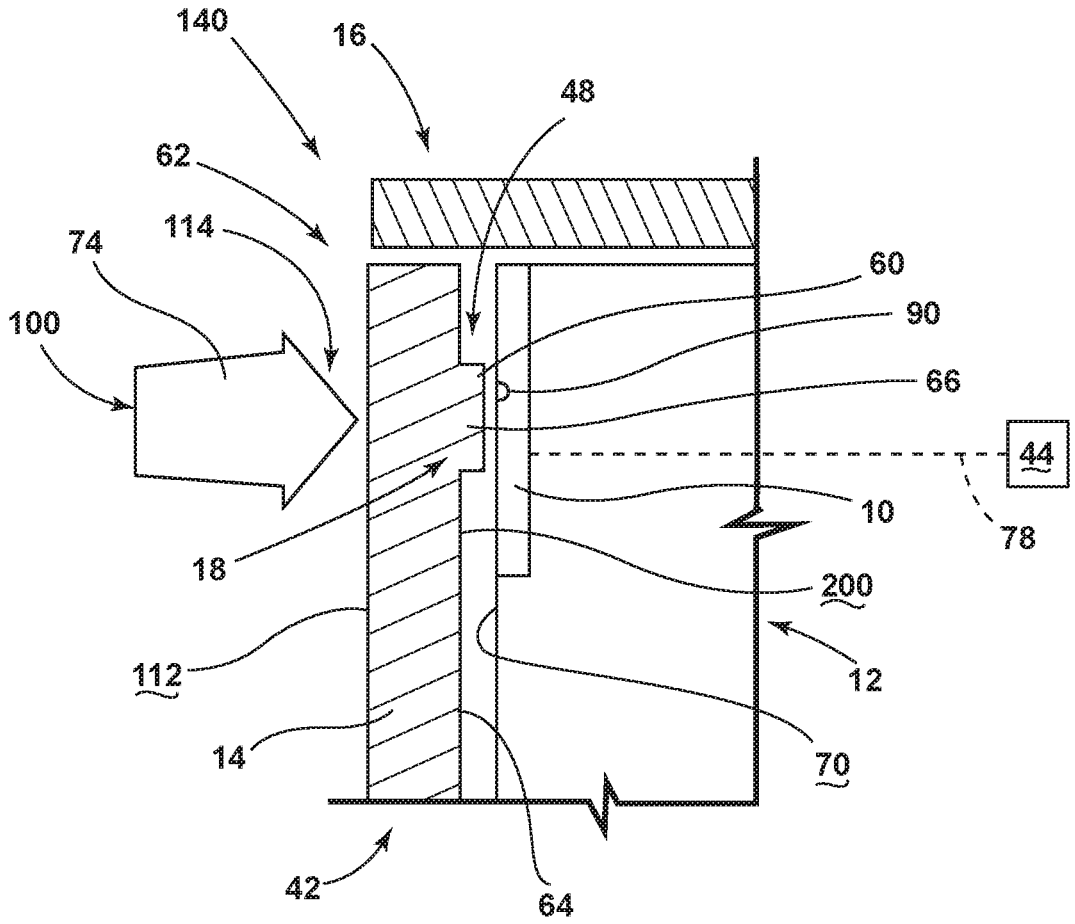
FIG. 5 is a schematic cross-sectional view of the appliance of FIG. 4, showing line IV-IV, and showing an aspect of the user interface for the appliance being engaged by a portion of the cosmetic outer panel.
Figure 6:
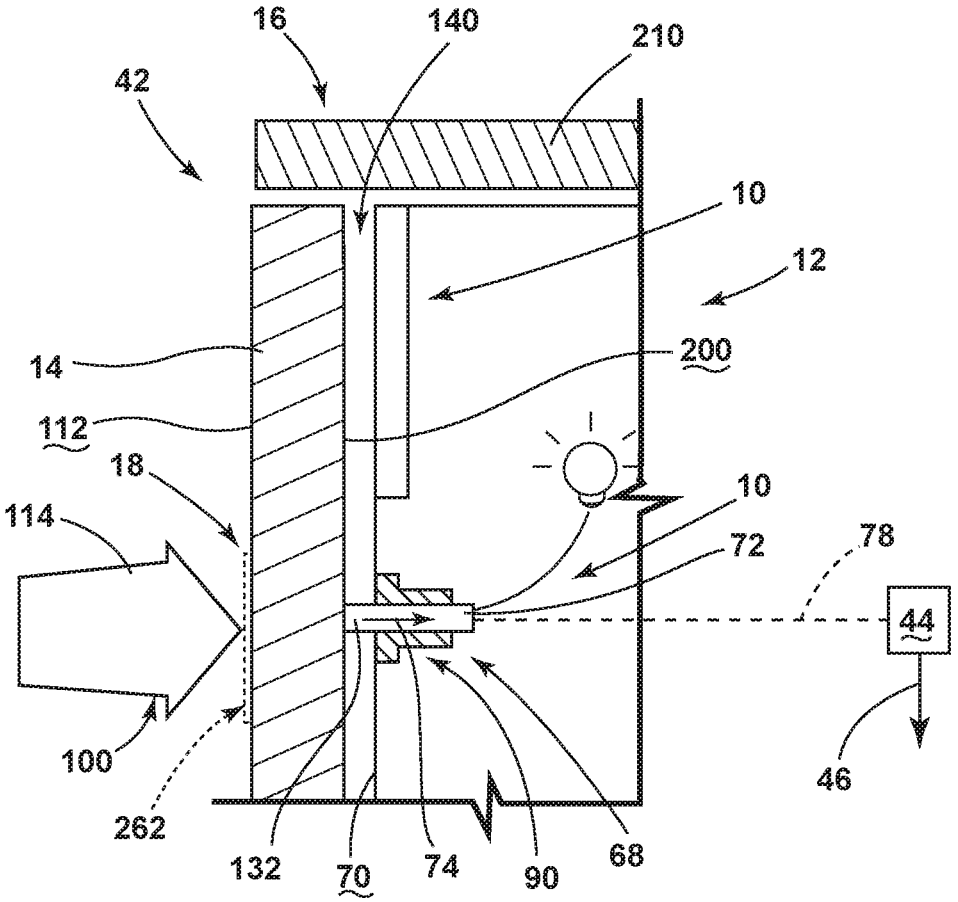
FIG. 6 is a cross-sectional schematic view of a laundry appliance having a cosmetic outer panel that can engage a light-activating plunger of the laundry appliance.

Referring now to FIGS. 5 and 6, a portion of the outer panel 14 for the cosmetic outer structure 16 can include an interface section 60 that is typically adjacent to the user interface 10 for the concealed appliance 12. This interface section 60 can be in an upper portion 62 of the outer panel 14 for the cosmetic outer structure 16. To engage the user interface 10 for the concealed appliance 12, a user can press against a predefined portion of the interface section 60 of the outer panel 14 of the cosmetic outer structure 16. This interface section 60 of the outer panel 14 can deflect in an inward movement 74 and directly engage the user interface 10 for the concealed appliance 12. The interior surface 64 of the outer panel 14 can include various protrusions 66 or other engaging surfaces that can be used to directly engage the user interface 10. It is also contemplated that an appliance switch 68, such as a plunger 132, can be incorporated within the outer surface 70 of the concealed appliance 12. When the outer panel 14 is deflected inward by the user, the interior surface 64 of the outer panel 14 can engage the appliance switch 68 to communicate with the controller 44 to modify an operating condition 46 for the concealed appliance 12. In various aspects of the device, this appliance switch 68 can also be used as a light-activating plunger 72 that automatically turns on a light within the appliance 12 when the door panel 38 for the appliance 12 is moved to the open position 40. This light-activating plunger 72 can be configured such that when an inward movement 74 of the light-activating plunger 72 is caused by the user, the inward movement 74 of the light-activating plunger 72 beyond a rest position 76 can send a signal 78 (shown schematically in FIG. 38) to the controller 44 and/or the user interface 10 to modify the operating condition 46 for the appliance 12.

Referring again to FIGS. 5 and 6, the pressure 100 exerted by the user against the outer panel 14 for the cosmetic outer structure 16 can be incorporated within a pressure sensor 90 that is incorporated within the appliance switch 68 located on an outer surface 70 of the concealed appliance 12. The pressure 100 applied by the user to the outer panel 14 can also be transferred into a strain gauge 92 that is incorporated within one or more hinges 94 of the outer panel 14 for the cosmetic outer structure 16. By pressing inward on the outer panel 14, thereby causing an inward movement 74 of the outer panel 14, the strain gauge 92 incorporated within the hinge 94 can be activated to send a signal 78 to the controller 44 for modifying an operating condition 46 for the concealed appliance 12. A pressure sensor 90 can also be attached to an outer surface 70 of the concealed appliance 12. A pressure sensor 90 can also be attached to the interior surface 64 of the outer panel 14 for the cosmetic outer structure 16.

Using the pressure sensor 90 and/or the strain gauge 92, the user can exert a predetermined amount of pressure 100 against the outer panel 14 for the cosmetic outer structure 16. This predetermined amount and/or duration of pressure 100 can send the signal 78 to the controller 44 to modify the operating condition 46 for the concealed appliance 12. It is also contemplated that a combination or pattern of pressure 100 exerted on the outer panel 14 can be received by the pressure-sensitive switch or strain gauge 92. This combination of exerted pressure 100 by the user can be perceived by the user interface 10 and/or the controller 44 as being indicative of an instruction to modify an operating condition 46 for the concealed appliance 12. By using a pattern of exerted pressures 100 by the user, an inadvertent bumping by the user against the cosmetic outer structure 16 can be distinguished from an intended engagement with the cosmetic outer structure 16 to modify an operating condition 46 for a concealed appliance 12.

To allow for sufficient deflection and inward movement 74 of the outer panel 14 for the cosmetic outer structure 16, the outer panel 14 can be made of a material that may have a greater ability to be deflected as desired to engage the intermediary interface 18 for engaging the user interface 10 for the concealed appliance 12. The interface section 60 of the outer panel 14 can be made of a separate material that naturally deflects in a greater capacity for allowing for more precise engagement of the user interface 10 for the concealed appliance 12. The hinges 94 for the appliance 12 can also be configured to at least rotate inward and toward the outer surface 70 of the concealed appliance 12.

Figure 7:
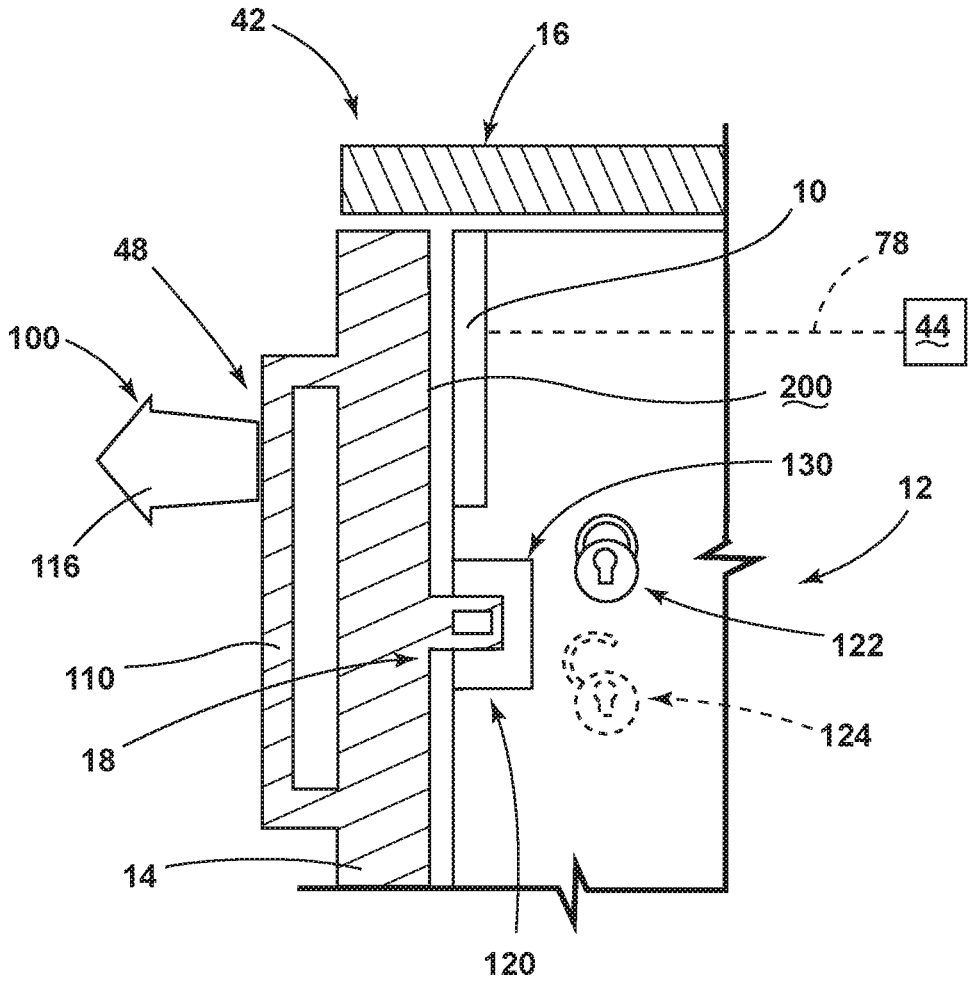
FIG. 7 is a schematic cross-sectional view of the laundry appliance showing engagement of the appliance user interface via a handle of the cosmetic outer panel.
Figure 8:
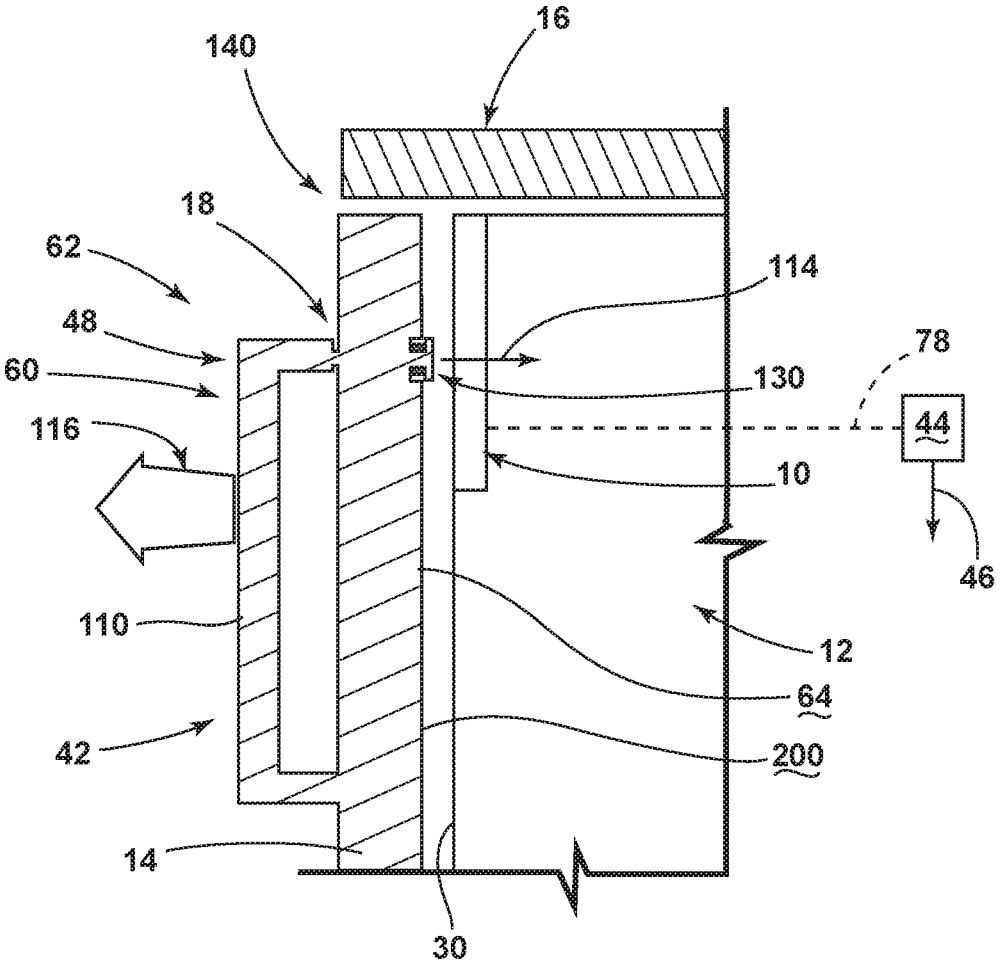
FIG. 8 is a schematic cross-sectional view of the laundry appliance showing engagement of the appliance user interface via a handle of a cosmetic outer panel.
Figure 9:
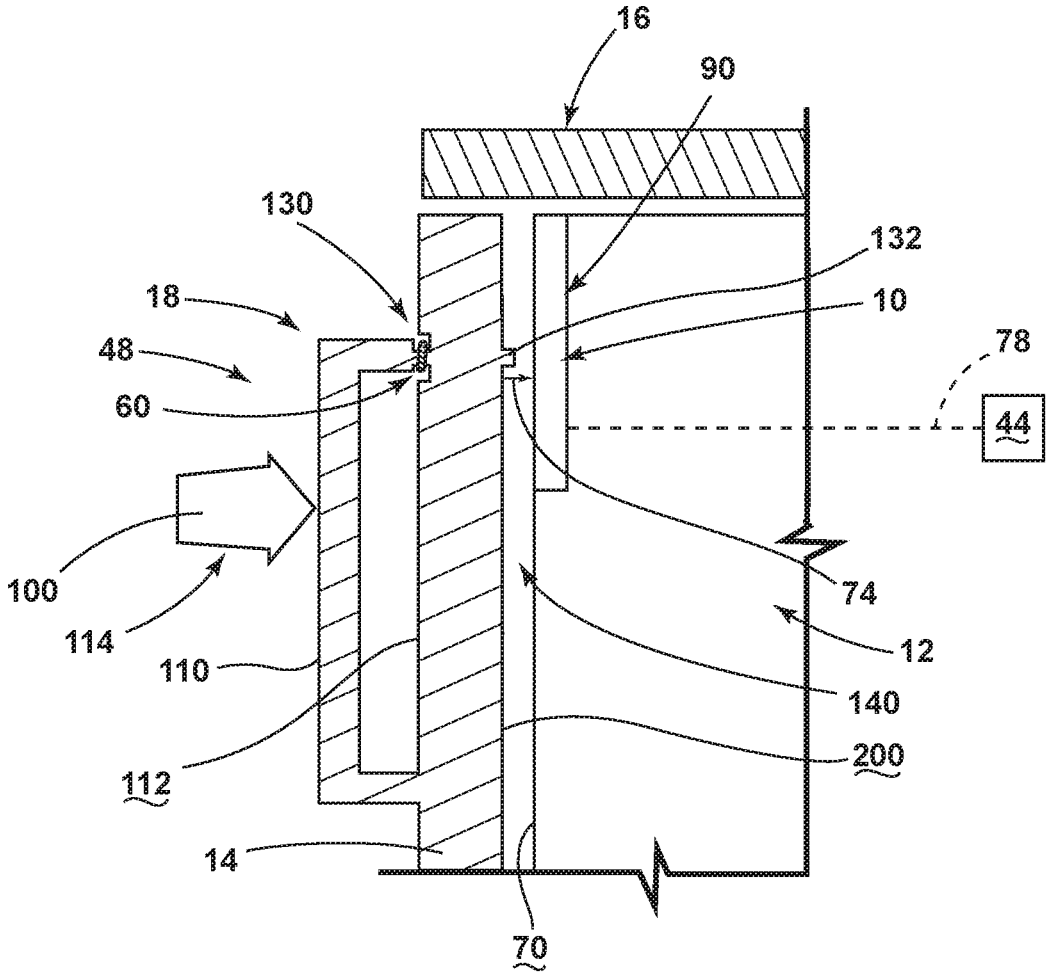
FIG. 9 is a schematic cross-sectional view of the laundry appliance showing engagement of the appliance user interface via a handle of a cosmetic outer panel.
Figure 10:
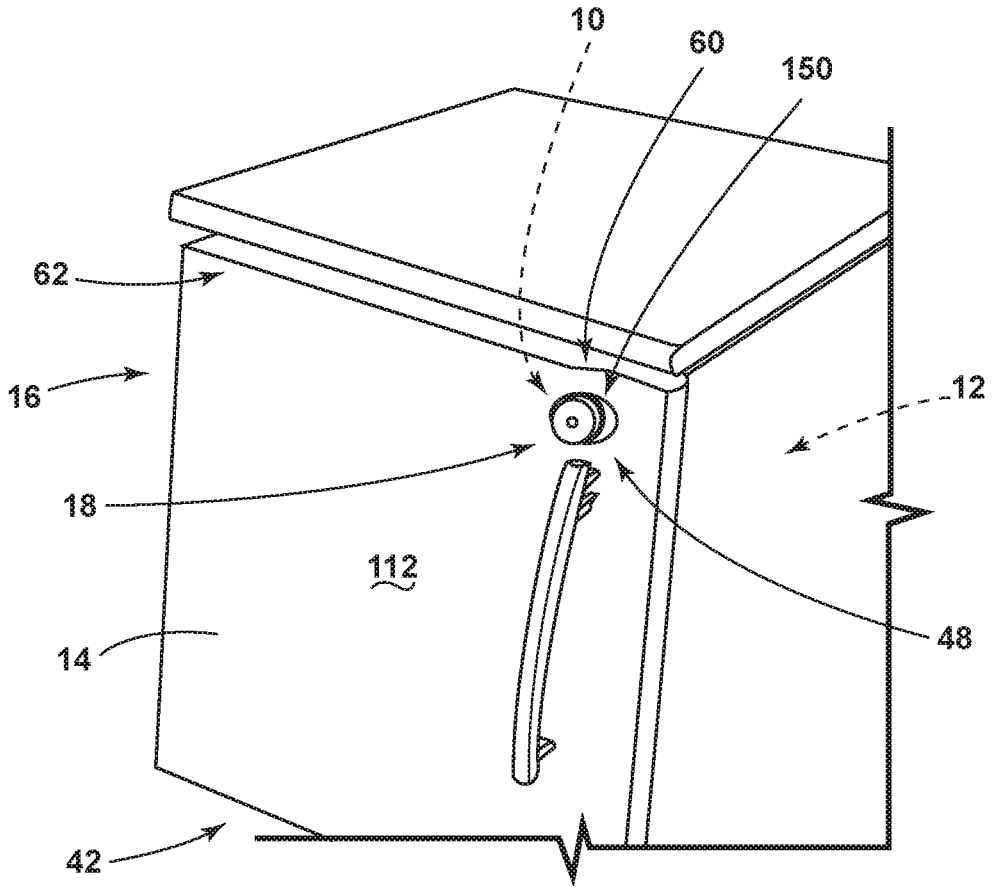
FIG. 10 is a perspective view of a cosmetic outer panel surrounding a laundry appliance and incorporating an external dial or switch for accessing the appliance user interface.
Figure 11:
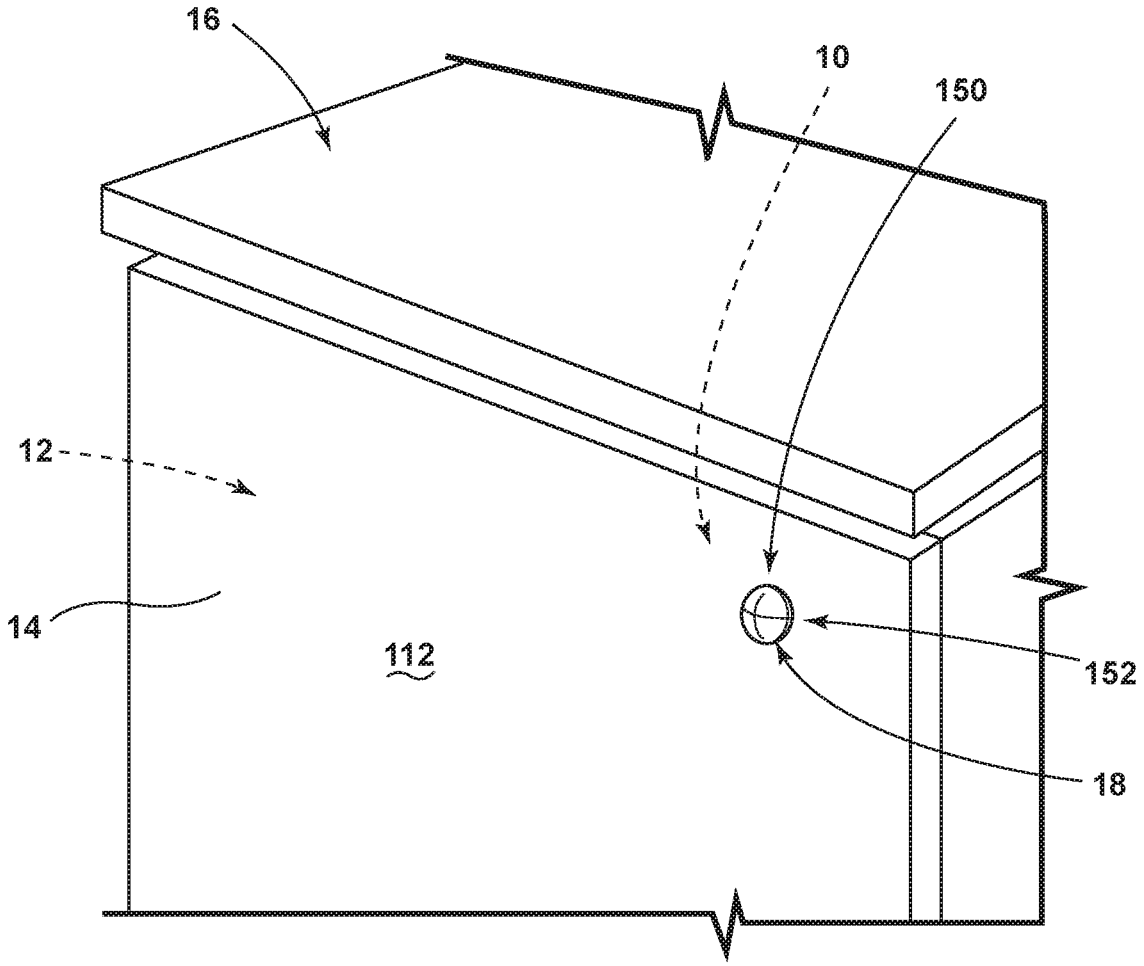
FIG. 11 is a front perspective view of a cosmetic outer panel surrounding an appliance and incorporating an aspect of a button for accessing the appliance user interface.
Figure 12:
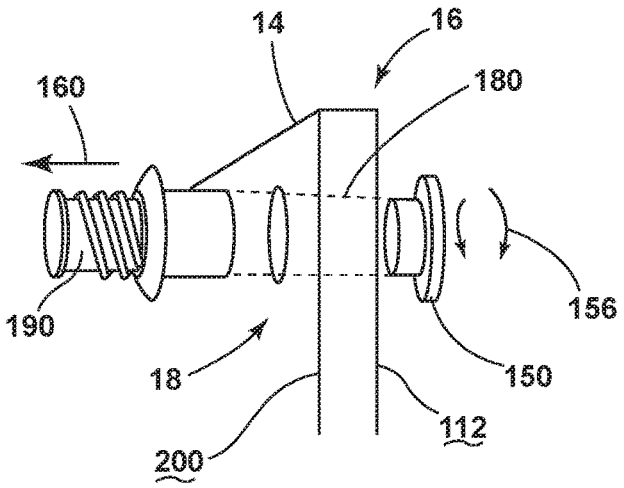
FIG. 12 is an exploded cross-sectional view of an aspect of a button positioned within a cosmetic outer panel for accessing the appliance user interface through the cosmetic panel.
Figure 13:
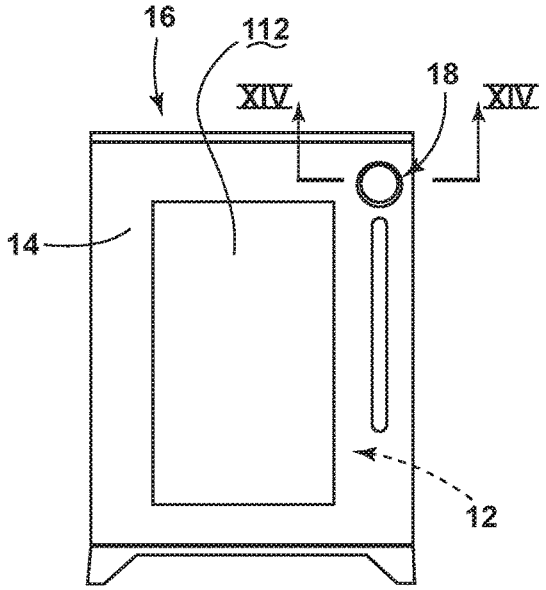
FIG. 13 is a front elevational view of an exterior cosmetic outer panel for concealing an appliance and incorporating an aspect of the button for engaging the appliance user interface.
Figure 14:
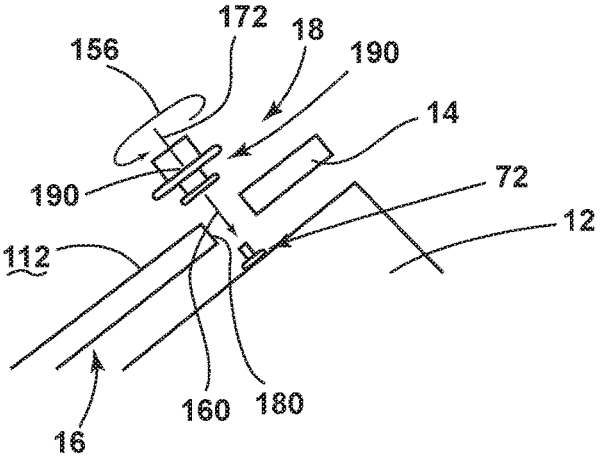
FIG. 14 is a partially exploded cross-sectional view of the appliance of FIG. 13, taken along line XIV-XIV, and showing the twisting operation of the button for the cosmetic outer panel to engage the appliance user interface.
Figure 15A:
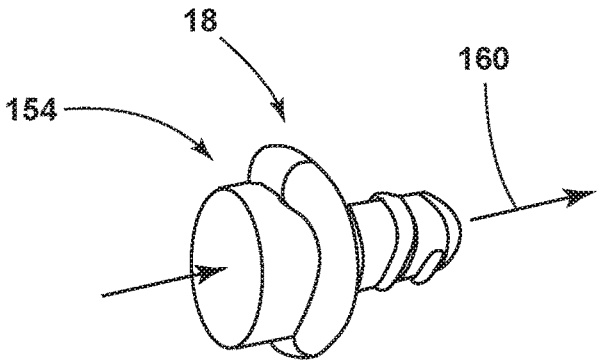
FIGS. 15*a* and 15*b* are enlarged perspective views of two designs for a push knob or twist knob that can be incorporated within the cosmetic outer panel for concealing the appliance.
Figure 15B:
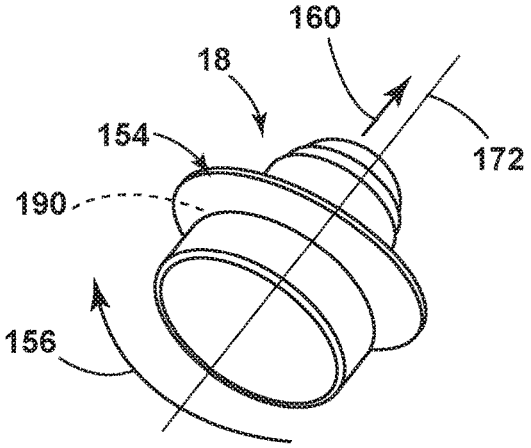

Referring now to FIGS. 7-9, the outer panel 14 for the cosmetic outer structure 16 can include a handle 110 that is attached to the exterior surface 112 of the outer panel 14. This handle 110 can include one or more pressure sensors 90 that can be activated by applied pressure 100, in the form of pulling or pushing the handle 110 with respect to the concealed appliance 12. By applying a predefined amount and/or duration of pressure 100 in an inward or outward direction 114, 116, or by applying a predetermined pattern of pressure 100 on the handle 110, the user can communicate an instruction through the intermediary interface 18 and to the controller 44 of the concealed appliance 12. The signal 78 to the controller 44 can be delivered directly to the controller 44 or can be sent via engagement of the user interface 10.

As exemplified in FIG. 7, the outer panel 14 for the cosmetic outer structure 16 can include a lock 120 to prevent, in a locked position 122, operation of the outer panel 14 to an open position 40. This lock 120 can be disengaged to an unlocked position 124 by providing the predetermined amount and/or duration of pressure 100 or pattern of pressure 100 to the handle 110. The lock 120 that is typically positioned within a portion of the concealed appliance 12 can include a pressure sensor 90 that can be activated, when desired. This instruction can be in the form of a signal 78 to deactivate the lock 120 to allow for the outer panel 14 and/or the door panel 38 to be opened. Additional instructions can include a signal 78 to the controller 44 to modify an operating condition 46 of the concealed appliance 12. As discussed above, where a user wishes to pause or stop operation of a particular operating condition 46, the user can engage the handle 110 by applying pressure 100 to the handle 110 in the inward or outward direction 114, 116. This engagement of the handle 110, which includes an aspect of the intermediary interface 18, can engage the lock 120 or provide the signal 78 to the controller 44 for modifying the operating condition 46.

As exemplified in FIGS. 8 and 9, a portion of a handle 110 can include one or more compression-detection mechanisms 130 within a portion of the handle 110 for the outer panel 14. These compression-detection mechanisms 130 can be in the form of springs, elastic members, motion sensors, pressure sensors 90, and other similar sensors that can detect a deflection, in inward or outward directions 114, 116, or change in pressure 100 exerted within a certain portion of the outer panel 14. By applying pressure 100 to the handle 110 in the inward or outward directions 114, 116 or in a predetermined combination of pressure 100 or with a predetermined amount and/or duration of pressure 100, the user can communicate the instruction via the intermediary interface 18 and the user interface 10, and to the controller 44 for modifying an operating condition 46 for the concealed appliance 12.

As exemplified in FIG. 8, the compression-detection mechanism 130 can be positioned within the interface section 60 of the outer panel 14 for the cosmetic outer structure 16. When the handle 110 is pulled, the compression-detection mechanism 130 can be activated. As discussed above, activating the compression-detection mechanism 130 may be configured as a combination-type interface. Where the compression-detection mechanism 130 perceives the proper amount of pressure 100, duration of pressure 100 and/or the proper combination of applied pressures 100, the compression-detection mechanism 130 can send a signal 78 to the controller 44 to modify an operating condition 46 for the concealed appliance 12. Where the improper amount of pressure 100 or the wrong combination of pressure 100 is exerted, no signal 78 is sent or a signal 78 can be delivered to the user that an inaccurate or non-conforming pressure 100 or inaccurate or non-conforming combination has been utilized.

Similarly, as exemplified in FIG. 9, the pressure sensor 90 or compression-detecting mechanism can be positioned near an exterior surface 112 of the outer panel 14. This pressure sensor 90 can be in the form of a plunger 132, spring, or other similar mechanism that can detect a pressure 100 exerted against the handle 110 in an inward or outward direction 116 by the user. As discussed above, the pressure sensor 90 can send a signal 78 to the controller 44 when a proper amount or duration of pressure 100 is applied to the handle 110 of the intermediary interface 18 or a proper combination of pressures 100 is exerted upon the handle 110. It is contemplated that the handle 110 incorporating the intermediary interface 18 can include a pressure sensor 90 that can detect pressures 100 exerted upon the handle 110 in both the inward and outward directions 114, 116 by the user.

According to various aspects of the device, where the handle 110 is pressed in the inward direction 114, the inward movement 74 of the handle 110 can activate a plunger 132 that directly engages the user interface 10 for the concealed appliance 12. Movement of the handle 110 in an outward direction 116 can be used to directly or indirectly engage a portion of the user interface 10 for the concealed appliance 12.

Referring again to FIGS. 5-9, it is contemplated that each of these intermediary interfaces 18 can be used after the user places a load of laundry within the appliance 12 and closes the outer panel 14. Before this, the outer panel 14 for the cosmetic outer structure 16 is opened and the user has direct access to the user interface 10. In this position, the user can directly engage the user interface 10 to start the operating condition 46 for the appliance 12, such as the washing cycle or drying cycle. When the outer panel 14 is opened, the intermediary interface 18 is in an idle state 142 (shown in FIG. 3) and is separated from the user interface 10. After directly engaging the user interface 10, the user can move the outer panel 14 to the closed position 42 to conceal the user interface 10 and the appliance 12. It is at this point that the intermediary interface 18 is in an active state 140 and can be utilized to modify the operating condition 46 for the concealed appliance 12. In the active state 140, the intermediary interface 18, typically the outer selector 48, is in physical contact with, or near physical contact with, the user interface 10.

According to various aspects of the device, when the outer panel 14 is moved to the closed position 42, a portion of the intermediary interface 18 can be in direct engagement with a portion of the user interface 10 for the concealed appliance 12 to define the active state 140 of the intermediary interface 18. In this aspect of the active state 140, discrete movements of the handle 110 or the outer panel 14 for the cosmetic outer structure 16, in the inward and outward directions 114, 116, can be received by the user interface 10 for the appliance 12. These discrete movements can be created by minimal amounts of pressure 100 or combinations of pressures 100 that can be exerted on the outer panel 14 for the cosmetic outer structure 16. Additionally, where the active state 140 of the intermediary interface 18 includes direct contact with the user interface 10, an applied pressure 100 in the outward direction 116, such as that exerted by the pulling of the handle 110, can result in a temporary detachment or disengagement of the intermediary interface 18 with the user interface 10. This temporary disengagement of these two members can be perceived as part of the pattern of pressures 100 or indicative of a sufficient pressure 100 or duration of pressure 100 to provide the signal 78 to the controller 44 for modifying the operating condition 46 for the concealed appliance 12.

In various aspects of the device, the active state 140 for the intermediary interface 18 can be defined by a portion of the intermediary interface 18 being positioned near to, but not necessarily in direct contact with, the user interface 10 for the concealed appliance 12. In such an embodiment, inward movement 74 of the intermediary interface 18 toward the user interface 10 for the concealed appliance 12 can result in an amount, duration, and/or pattern of pressure 100 being received by one of the intermediary interface 18 and/or the user interface 10 for the concealed appliance 12. In the various aspects of the device where the intermediary interface 18 includes a physical movement of a portion of the cosmetic outer structure 16, the intermediary interface 18 can be caused to be in direct contact with the user interface 10 for the concealed appliance 12. A change in the amount, duration, or pattern of contact, or pressure 100, between the intermediary interface 18 and the user interface 10 for the concealed appliance 12 can also be perceived in the various embodiments of the device.

Referring now to FIGS. 10-16, the intermediary interface 18 can be in the form of a dial 374, knob 154, button 152 or other similar selector position on an outer surface 70 of the cosmetic outer structure 16. As identified in FIG. 12, the button 152 can be in the form of a typical spring-activated button 152 to be engaged by a user by depressing a portion of the button 152 from the outside of the cosmetic outer structure 16. Inward movement 74 of the button 152 toward the user interface 10 for the concealed appliance 12 can result in direct contact between the button 152 and the user interface 10 for modifying an operating condition 46 for the concealed appliance 12. As exemplified in FIGS. 14-15*b*, the selector 150 can also be a rotationally-operable knob 154 that can be rotated to cause movement in the inward and outward directions 114, 116 of a protrusion 66 with respect to the user interface 10 for the concealed appliance 12. This rotation of the external selector 150 can be calibrated such that different commands can be conveyed via the user interface 10 to the controller 44 through different rotational movements of the external selector 150.

By way of example, and not limitation, the external selector 150 can be rotated a quarter turn that results in a first amount of lateral movement 160 of the intermediary interface 18 in the inward or outward directions 114, 116 relative to the user interface 10 for the concealed appliance 12. Similarly, a one-half rotation, three quarter rotation or other degree of rotational movement 156 can result in greater degrees of lateral movement 160 of the protrusion 66 for the external selector 150 in the inward or outward directions 114, 116 relative to the user interface 10 for the concealed appliance 12. These various degrees of lateral movement 160 of the external selector 150 relative to the user interface 10 can result in different command signals 78 being conveyed by the user interface 10 via the intermediary interface 18. To assist the user in detecting various amounts of rotational movement 156 and, in turn, lateral movement 160 of the external selector 150, detents, tabs, and other haptic-feedback mechanisms can be incorporated within the external selector 150 for communicating to the user an amount of rotational movement 156 that has been achieved through operation of the intermediary interface 18.

The external selector 150 that is in the form of the button 152 or rotationally-operable knob 154 can be used in conjunction with a plunger 132 or other pressure sensitive mechanism that can be used to perceive movement of the button 152 and/or external knob 154 for the intermediary interface 18. The button 152 and/or the external knob 154 can be used in conjunction with an amount of pressure 100 exerted against, and by, the intermediary interface 18, the duration of pressure 100 exerted as well as a pattern of pressures 100 exerted by the intermediary interface 18. The amount, duration, and/or pattern of pressure 100 exerted by the intermediary interface 18 can be used to communicate various instructions to the controller 44 via the user interface 10.

Figure 16:
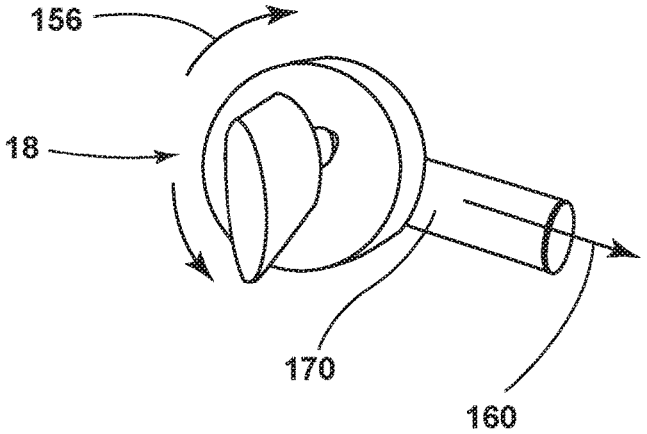
FIG. 16 is a perspective view of an aspect of the dial or switch that can be incorporated within the cosmetic outer panel and incorporating a deadbolt-type engagement mechanism.

Referring now to FIG. 16, the external selector 150 can be in the form of an operable bolt 170, such as a deadbolt, that can operate a protrusion 66 in a direction perpendicular to a rotational axis 172 of the external selector 150. When the external selector 150 is rotated, the bolt 170 can be moved laterally to engage a portion of the user interface 10 or for engaging a lock 120 for securing the outer panel 14 to the remainder of the cosmetic outer structure 16.

Referring again to FIGS. 10-16, where the intermediary interface 18 includes a button 152, the button 152 can pass through an opening 180 or other aperture that is defined within the outer panel 14 for the cosmetic outer structure 16. The button 152 can be in the form of a spring-loaded plug assembly that is inserted through the opening 180. This button 152 can pass completely through the outer panel 14 and can be positioned near or in direct engagement with the user interface 10 for the concealed appliance 12. In such an embodiment, the button 152 is typically a mechanical intermediary interface 18 that directly engages the user interface 10 for the concealed appliance 12. Accordingly, electricity typically need not be run through the cosmetic outer structure 16 for operating a mechanical intermediary interface 18. Similarly, where the intermediary interface 18 includes the rotationally operable knob 154, the twist knob 154 can be positioned through the opening 180 in the outer panel 14 for the cosmetic outer structure 16. When the user twists the knob 154, a plunger 132 or other protrusion 66 can be laterally operated relative to or through the outer panel 14 to directly engage a portion of the user interface 10 for the concealed appliance 12. Again, using this mechanical aspect of the interface, no electrical wiring typically is needed for operation of the intermediary interface 18.

According to various aspects of the device, the external selector 150 can be in the form of a two-piece mechanism, the outer piece being a rotationally-operable knob 154 or dial 374 that is positioned on or near an exterior of the outer panel 14. The second piece of the external selector 150 can include a laterally operable protrusion 66 of the external selector 150. In such an embodiment, the laterally operable knob 154 can be engaged to the rotationally operable protrusion 66 via a helical structure 190 or other transfer mechanism that converts rotational movement 156 of the outer selector 48 to lateral movement 160 of the inner protrusion 66 of the external selector 150.

According to various aspects of the device, the external selector 150 can be incorporated within an exterior surface 112 of the outer panel 14 or can be incorporated within an aspect of the handle 110 for the outer panel 14. In these various embodiments, the handle 110, button 152, knob 154, other external selector 150 or other similar mechanically operable intermediary interface 18 can be disguised within the outer panel 14 for the cosmetic outer structure 16. In this manner, the aesthetics of the intermediary interface 18 can take the form of conventional door hardware, cabinetry hardware patterns within the cosmetic outer structure 16, or other similar aesthetic feature that may be typically seen within cabinetry and other household furniture.

Referring again to FIGS. 1-38, it is contemplated that the outer panel 14 for the cosmetic outer structure 16 can be directly attached to the door panel 38 for the concealed appliance 12. In this manner, when the user operates the outer panel 14 for the cosmetic outer structure 16, the door panel 38 for the appliance 12 is also moved to the open position 40. Accordingly, where the outer panel 14 and the door panel 38 for the appliance 12 are connected, the user is not required to open two separate doors for accessing the interior of the appliance 12. In such an embodiment, the outer panel 14 and the operable door panel 38 may be fixedly or solidly linked together. The outer panel 14 may also be temporarily engaged with the operable door panel 38 via magnets or other similar releasable mechanisms. Where the outer panel 14 and operable door panel 38 are connected together, the intermediary interface 18 can be operable independent of the operable door panel 38 to provide for selective engagement with the user interface 10 of the concealed appliance 12.

In various aspects of the device, where the cosmetic outer structure 16 is manufactured as part of the appliance 12, the outer panel 14 for the cosmetic outer structure 16 can take the form of the door panel 38 for the appliance 12, such that a single door panel 38 is included. In such an embodiment, the interior side 200 of the door panel 38 can be similar to that of a conventional appliance door panel 38. Conversely, the outer side or exterior surface 112 of the door panel 38 is indicative of the cosmetic outer structure 16 that appears to be similar to that of furniture, cabinetry or other household fixtures.

In each of these embodiments, the intermediary interface 18 is a separate component from the user interface 10 for the appliance 12. The user interface 10 typically includes lights, buttons 152, dials 374, and other features that may be distracting or detrimental to the aesthetic of cabinetry or other conventional household fixtures within an appliance 12. Accordingly, the intermediary interface 18 is used to conceal the user interface 10 for the appliance 12 and also provide functionality for accessing the user interface 10 for the concealed appliance 12 through the outer panel 14 for the cosmetic outer structure 16.

Figure 17:
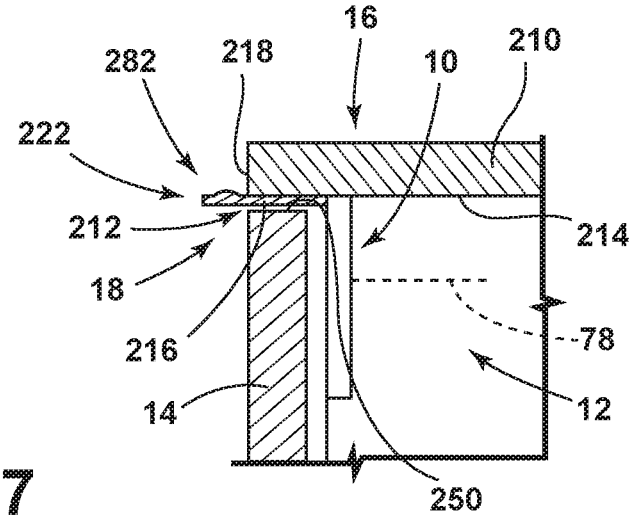
FIG. 17 is a cross-sectional view of a cosmetic outer panel and interior laundry appliance having a portion of the user interface extend through a gap in the cosmetic outer panel.
Figure 18:
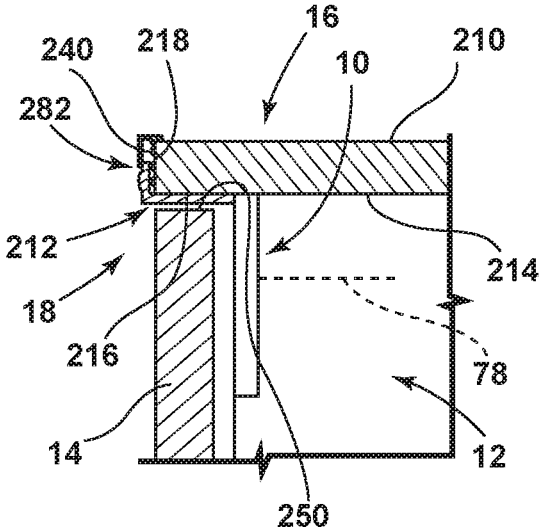
FIG. 18 is a cross-sectional view of a cosmetic outer panel and interior laundry appliance having a portion of the user interface extend through a gap in the cosmetic outer panel.
Figure 19:
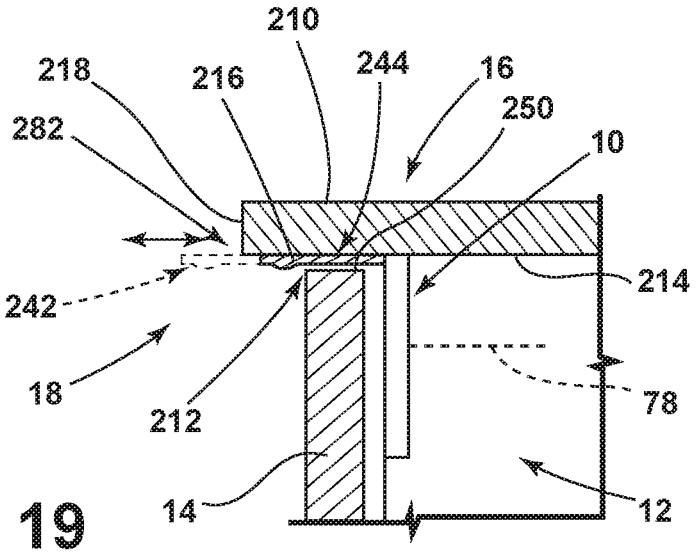
FIG. 19 is a cross-sectional view of a cosmetic outer panel and concealed laundry appliance having a portion of the user interface extend through a gap in the cosmetic outer panel.
Figure 20:
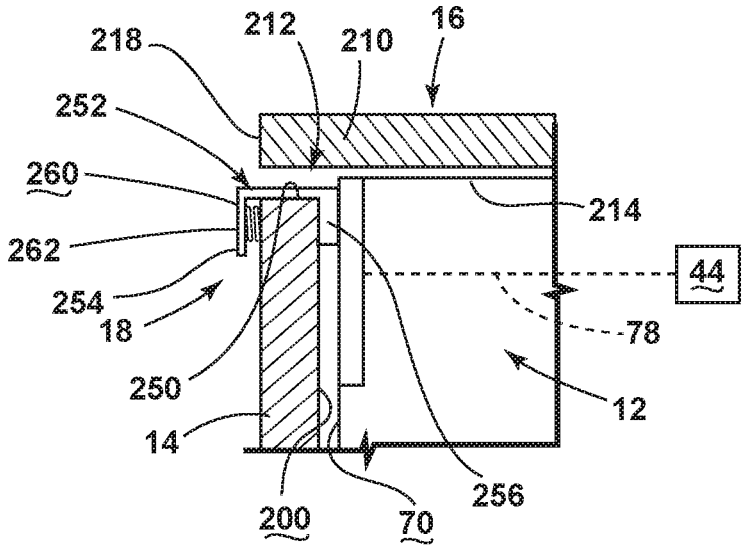
FIGS. 20-23 illustrate various views of a wrap-around switch surrounding an edge of the outer cosmetic panel and operable to engage one or more portions of the user interface for the interior appliance.

Referring now to FIGS. 17-19, the cosmetic outer structure 16 can include a top panel 210 that can be made of wood, particle board, engineered lumber, solid surfacing, laminate, and other conventional materials typically included within furniture and cabinetry. Between the outer panel 14 for the cosmetic outer structure 16 and the top panel 210, a gap 212 can be present that allows space for the outer panel 14 to move between the open and closed positions 40, 42 without rubbing against the underside 214 of the top panel 210. Within this gap 212, a portion of the user interface 10 or an extension 216 of the user interface 10 can extend through this gap 212. In this manner, the intermediary interface 18 can be this extension 216 of the user interface 10 that is positioned through the gap 212 between the outer panel 14 and the top panel 210.

As exemplified in FIGS. 17-19, this extension 216 that defines the intermediary interface 18 can have various engagement mechanisms that can include, but are not limited to, buttons 152, touch screens, switches, dials 374, knobs 154, pressure sensors 90 and other similar engagement mechanisms that can be used to transmit signals 78 from the intermediary interface 18 and to the controller 44 via the user interface 10 for the concealed appliance 12. This extension 216 of the user interface 10 that makes up the intermediary interface 18 can include an upward-facing intermediary interface 18 that extends forward of the top panel 210 for the appliance 12. This extension 216 can also extend upward and be located at a front edge 218 of the top panel 210 for the appliance 12, as exemplified in FIG. 18. The intermediary interface 18 can also be positioned on an underside 214 of the top panel 210, where the intermediary interface 18 can be accessed from below. In each of these conditions, the intermediary interface 18 is an extension 216 of the user interface 10 for the appliance 12, such that electricity or other wiring need not be run to the cosmetic outer structure 16 surrounding the concealed appliance 12.

Referring again to FIGS. 17-19, the extension 216 that forms the intermediary interface 18 can be a relatively small portion that includes a very limited amount of selectable laundry-processing functions 222. Accordingly, the extension 216 of the user interface 10 for the appliance 12 that makes up the intermediary interface 18 can be a very discreet and small-sized member that is positioned through the gap 212 between the outer panel 14 and the top panel 210. This extension 216 can be concealed near a hinge 94 for the cosmetic outer structure 16 or near a handle 110 for the cosmetic outer structure 16. The positioning of the extension 216 that makes up the intermediary interface 18 is positioned such that it does not interfere with movement of the outer panel 14 between the open and closed positions 40, 42. The extension 216 of the user interface 10 can also be disguised within various patterns and other aesthetic features of the cosmetic outer structure 16 so that the intermediary interface 18 is at least partially concealed from view, but is also readily accessible when needed.

Figure 2:
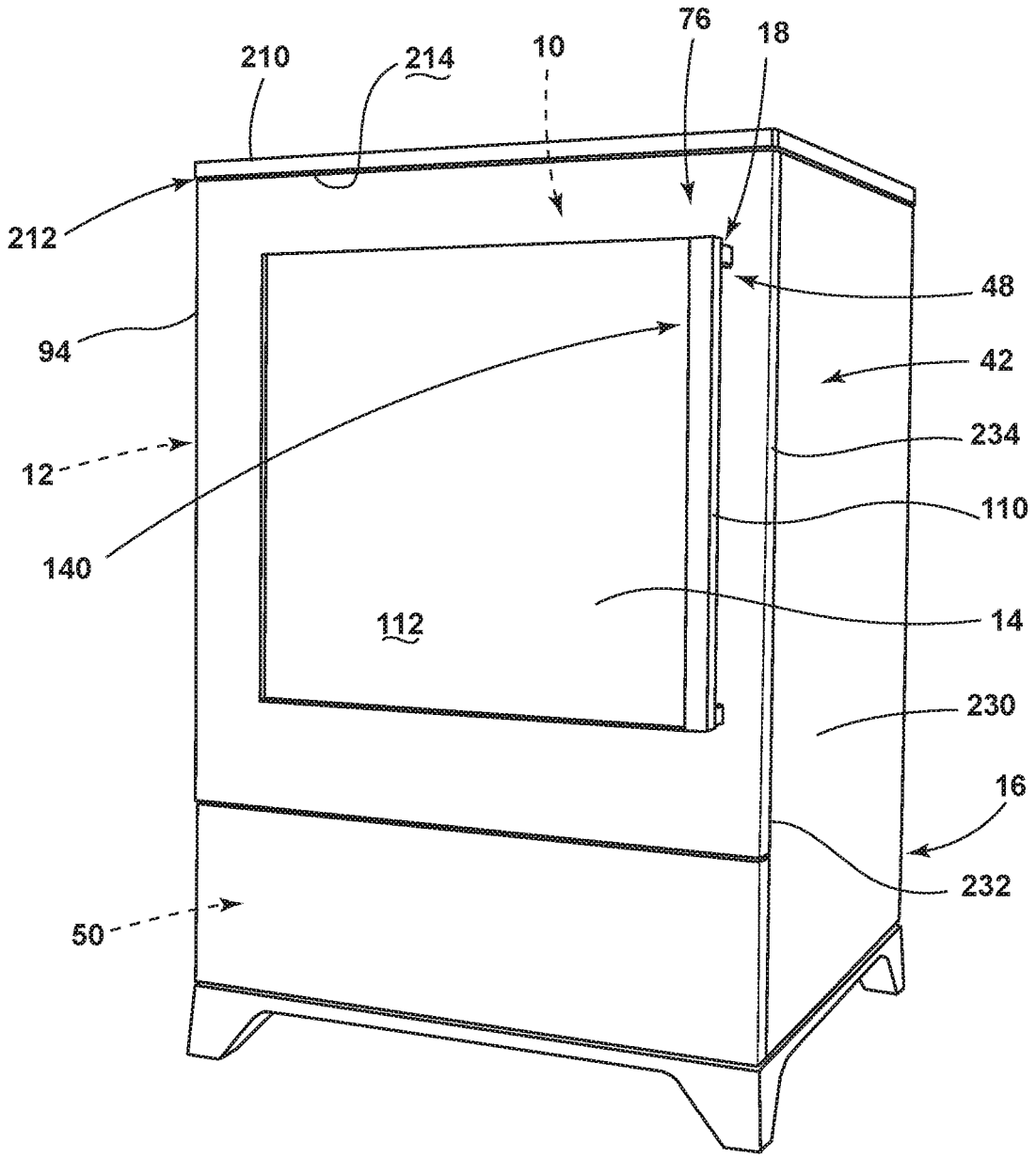
FIG. 2 is a front perspective view of a laundry appliance having a cosmetic outer structure positioned around the outer surface of the laundry appliance.
Figure 3:
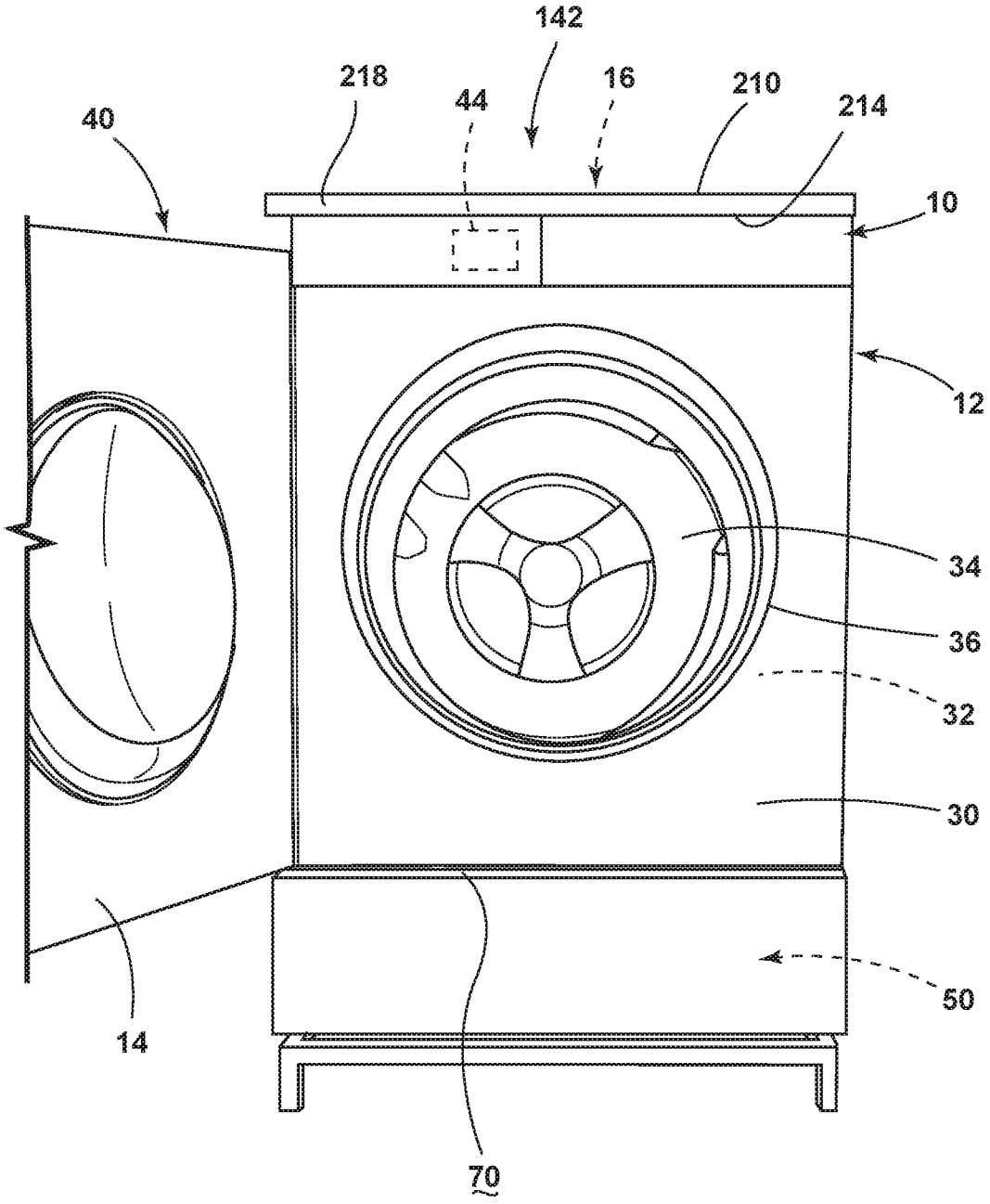
FIG. 3 is a front perspective view of the laundry appliance of FIG. 2 showing the cosmetic outer panel and the appliance door in an open position.

According to various aspects of the device, as exemplified in FIGS. 17-19, the extension 216 of the user interface 10 that forms the intermediary interface 18 can be positioned on a sidewall 230 of the cosmetic outer structure 16 (shown in FIG. 2). In such an embodiment, the gap 212 that is present between the outer panel 14 and the top panel 210 extends around the perimeter 232 of the outer panel 14. The extension 216 of the user interface 10 for the concealed appliance 12 can extend through various portions of the gap 212 to provide access to the intermediary interface 18. Where the extension 216 passes through a side-portion 234 of this gap 212, the intermediary interface 18 can be positioned rearward of the gap 212 to not interfere with the outer panel 14 as it moves between open and closed positions 40, 42.

To further conceal the extension 216 of the user interface 10 that forms the intermediary interface 18, the cosmetic outer structure 16 can include a recess 240 or notch that receives the extension 216 of the user interface 10. This extension 216 can be positioned within the recess 240 to further conceal the presence of the intermediary interface 18 from view, while also being readily accessible to the user when needed. Also, where the extension 216 is positioned within a recess 240, the intermediary interface 18 can have a substantially flush configuration with the surrounding areas of the cosmetic outer structure 16.

Referring again to FIGS. 17-19, the extension 216 of the user interface 10 that forms the intermediary interface 18 can be operable relative to the concealed appliance 12 and the cosmetic outer structure 16. In such an embodiment, the extension 216 of the user interface 10 can be extended and retracted from various portions relative to the cosmetic outer structure 16 to be concealed and not in use. When not needed, the user can retract the extension 216 inward toward the gap 212 to at least partially conceal the extension 216 of the user interface 10. Alternatively, when needed, the user can operate the extension 216 of the user interface 10 to reveal various controls that can be engaged for modifying the operating condition 46 of the appliance 12, as desired. In this embodiment, the extension 216 of the user interface 10 can be linearly or rotationally operable relative to the user interface 10 and cosmetic outer structure 16. The extension 216 can also be slidably operable between extended and retracted positions 242, 244 for concealing and revealing the presence of the extension 216 of the user interface 10 that forms the intermediary interface 18.

Referring now to FIGS. 20-23, the intermediary interface 18 can include an operable portion that at least partially wraps around an edge 250 of the outer panel 14 for the cosmetic outer structure 16. As exemplified in FIG. 20, the intermediary interface 18 can include a slidably operable bracket 252 or button 152 having an exterior portion 254 that is visible in front of the outer panel 14 for the cosmetic outer structure 16. This bracket 252 that extends around the edge 250 of the outer panel 14 can be spring-biased away from the user interface 10 for the concealed appliance 12. When the bracket 252 is pressed in the inward direction 114 toward the exterior surface 112 of the outer panel 14, an inward portion 256 of the bracket 252 is configured to directly engage a portion of the user interface 10 for the concealed appliance 12. In this manner, the bracket 252 is slidably operable relative to the edge 250 of the outer panel 14 for selectively engaging the user interface 10 to modify the operating condition 46 for the concealed appliance 12.

Figure 21:
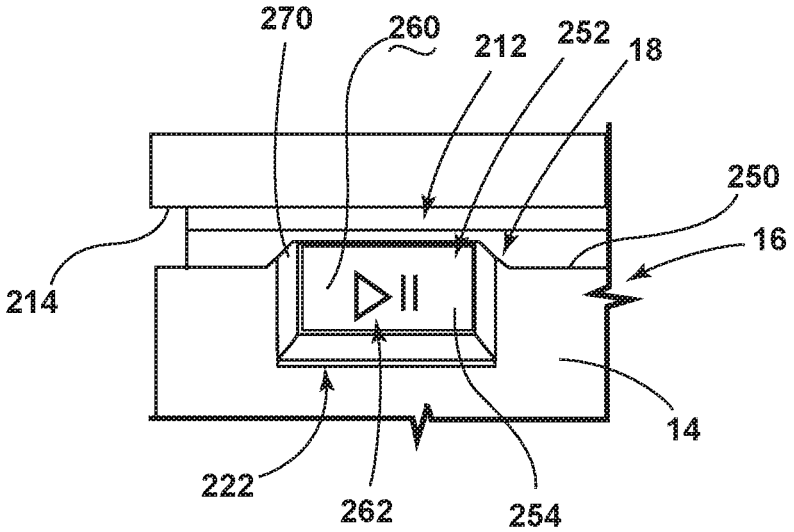
Figure 22:
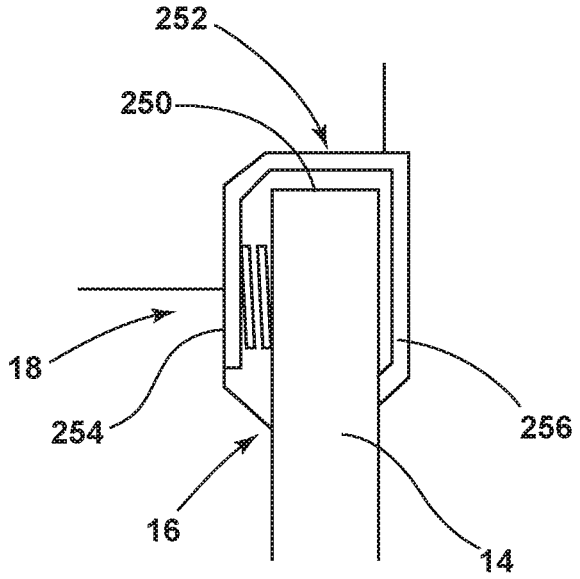

As exemplified in FIGS. 21 and 22, the external surface 260 of the bracket 252 can include various indicia 262 that communicates to the user the laundry-processing function 222 that can be activated by engaging a particular portion of the intermediary interface 18. Additionally, the intermediary interface 18 can include a plurality of brackets 252 that each includes a separate engagable portion for modifying the operating condition 46 for the appliance 12. By way of example, and not limitation, the intermediary interface 18 can include two brackets 252, where a first bracket 264 is used for pausing the operating condition 46 of the concealed appliance 12. A second bracket 266 can be used for starting, stopping or unpausing the operating condition 46 for the concealed appliance 12. Additional brackets 252 can be included within the intermediary interface 18 for providing additional functional capabilities to a user without opening the outer panel 14 for the cosmetic outer structure 16.

Figure 23:
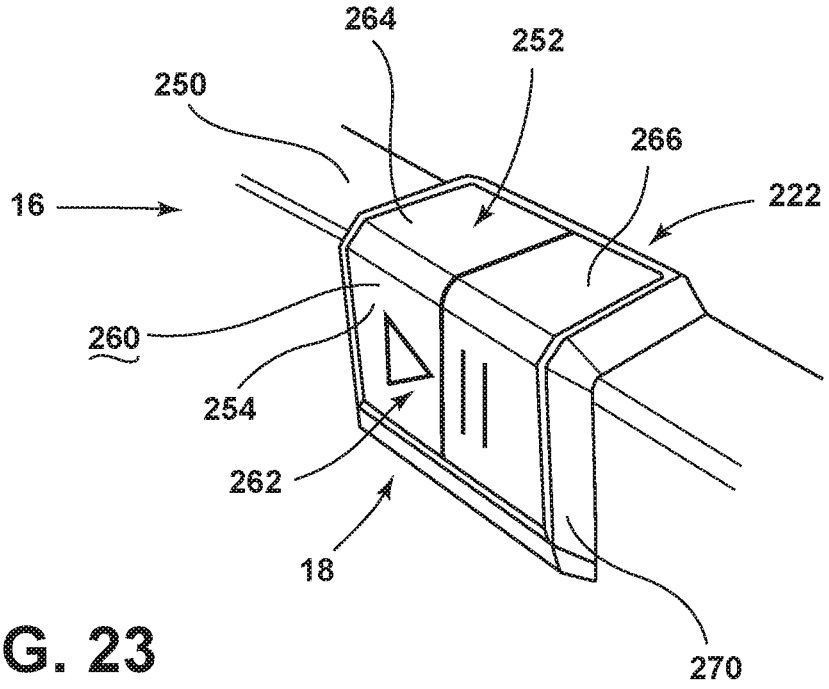

According to various aspects of the device, as exemplified in FIGS. 21-23, the brackets 252 can include an outer frame 270 that is fixed to the edge 250 of the outer panel 14 and can at least partially extend around the edge 250 for the outer panel 14. This outer frame 270 can receive multiple operable brackets 252, at least in the form of the first and second brackets 264, 266, that can be moved separately and independently within the fixed outer frame 270 for moving toward and away from the user interface 10 for the concealed appliance 12. As with other aspects of the intermediary interface 18, each of the brackets 252 can be used in conjunction with pressure sensors 90 that can measure an amount of pressure 100 exerted against the user interface 10 by the operation of the intermediary interface 18, a duration of pressure 100 exerted or a pattern of pressures 100 exerted against the user interface 10 by the intermediary interface 18. As discussed above, the pressure sensor 90 can be used to distinguish between an inadvertent engagement of the intermediary interface 18 and an intentional engagement of the intermediary interface 18 to modify an operating condition 46 of the concealed appliance 12.

Figure 24:
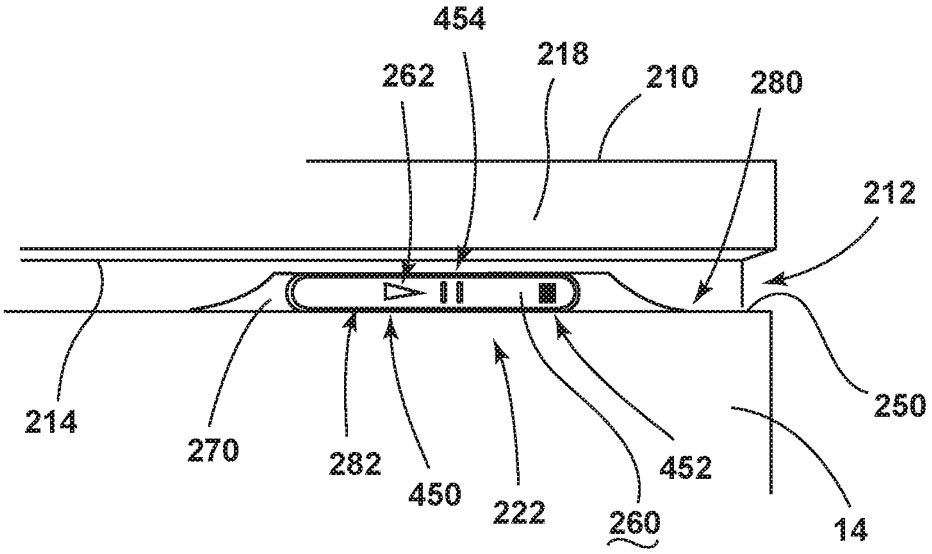
FIGS. 24 and 25 illustrate an aspect of a sliding switch attached to an outer edge of the outer cosmetic panel for concealing the appliance.
Figure 25:
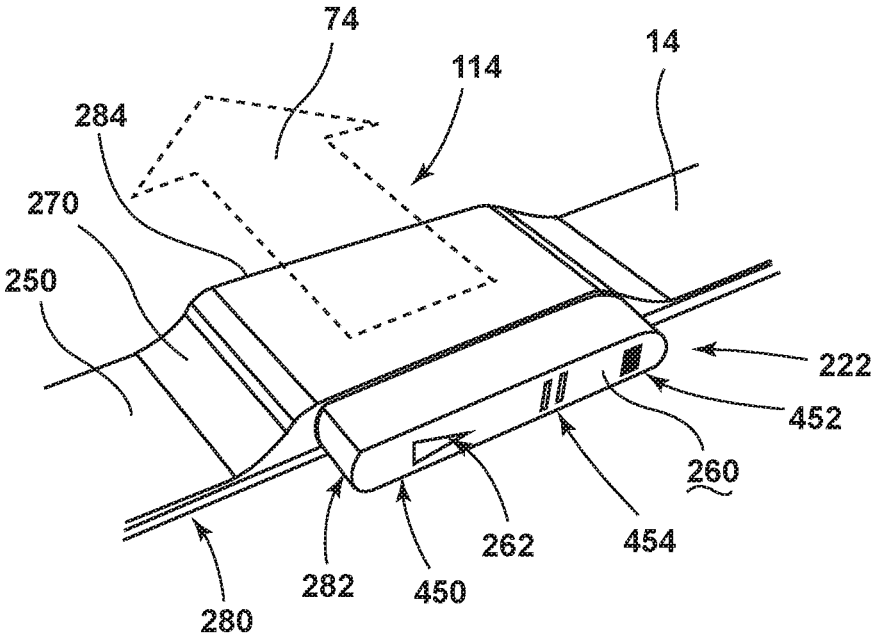

Referring now to FIGS. 24 and 25, the intermediary interface 18 can take the form of a button 152 or other plunger-type selector 150, or gap selector 282 that is positioned within the gap 212 that is defined between the top portion 280 of the outer panel 14 and the underside 214 of the top panel 210 for the cosmetic outer structure 16. Similar to the configurations exemplified in FIGS. 20-23, the gap selector 282 for the intermediary interface 18 can be slidably engaged with a top edge 250 of the outer panel 14 and within an outer frame 270 that allows for slidable operation of the gap selector 282. This gap selector 282 can be biased in an outward direction 116 and away from the user interface 10 for the concealed appliance 12. When the user desires to modify the operating condition 46 for the concealed appliance 12 without opening 180 the outer panel 14, the user can engage the gap selector 282 in an inward direction 114. A rear surface 284 of the gap selector 282 directly engages the user interface 10 for the concealed appliance 12 to modify the operating condition 46 for the concealed appliance 12. As discussed herein, these operating conditions 46 can include various laundry-processing functions 222, which can include, but are not limited to, a motor start function 450, a motor stop function 452 and motor pause function 454.

According to various aspects of the device, the intermediary interface 18 can include a plurality of gap selectors 282 that can be used to engage different portions of the user interface 10 for a concealed appliance 12. It is also contemplated that a single gap selector 282 can be used to engage a single portion of the user interface 10.

According to various aspects of the device, as exemplified in FIGS. 20-25, the bracket 252 and gap selector 282 for the intermediary interface 18 can include an illuminated section. This illuminated section can be powered by an internal light fixture that illuminates a portion of the bracket gap selector 282. This internal light fixture can be battery powered, wired, or inductively powered. The illuminated section can also be a substantially clear or at least partially translucent section that allows light from the user interface 10 from the concealed appliance 12 to pass through the intermediary interface 18 to provide an illuminated indicia 262 to the user that is related to the location of the intermediary interface 18 or the current status of the operating condition 46 being performed by the concealed appliance 12.

Figure 26:
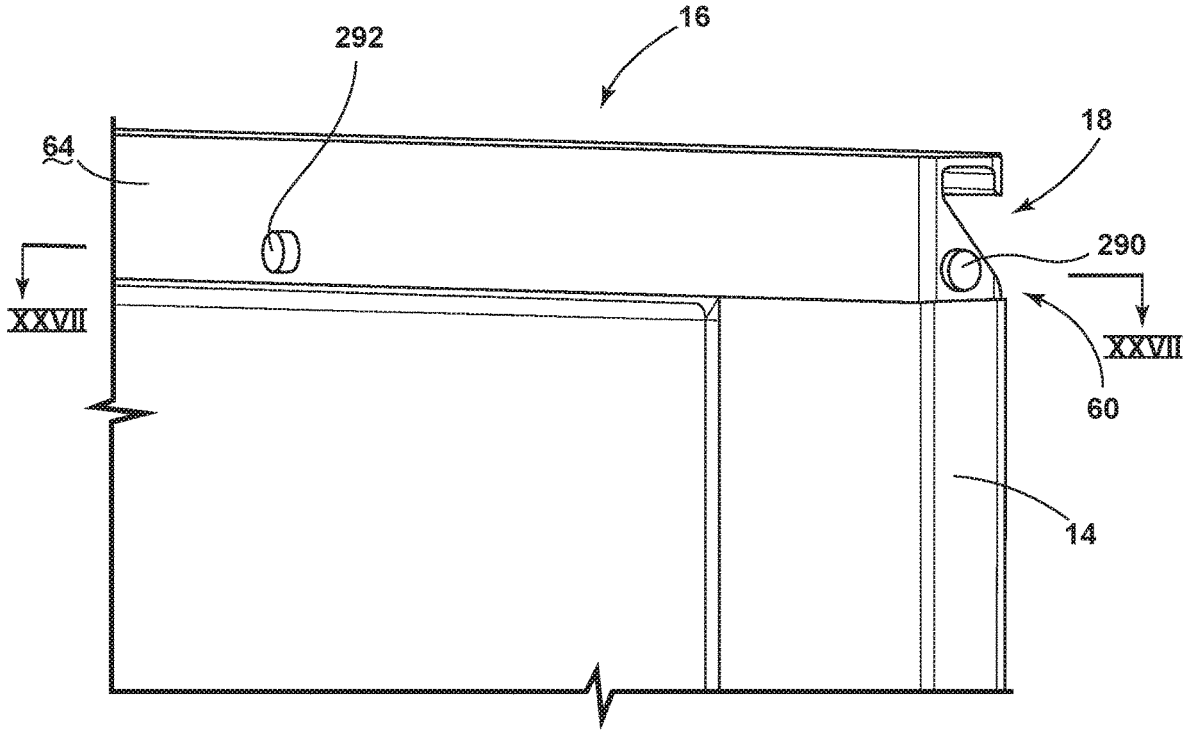
FIG. 26 is a rear perspective view of a cosmetic outer panel for an appliance and illustrating a side actuator button that operates a central actuating plunger for engaging the user interface for the interior appliance.
Figure 27:
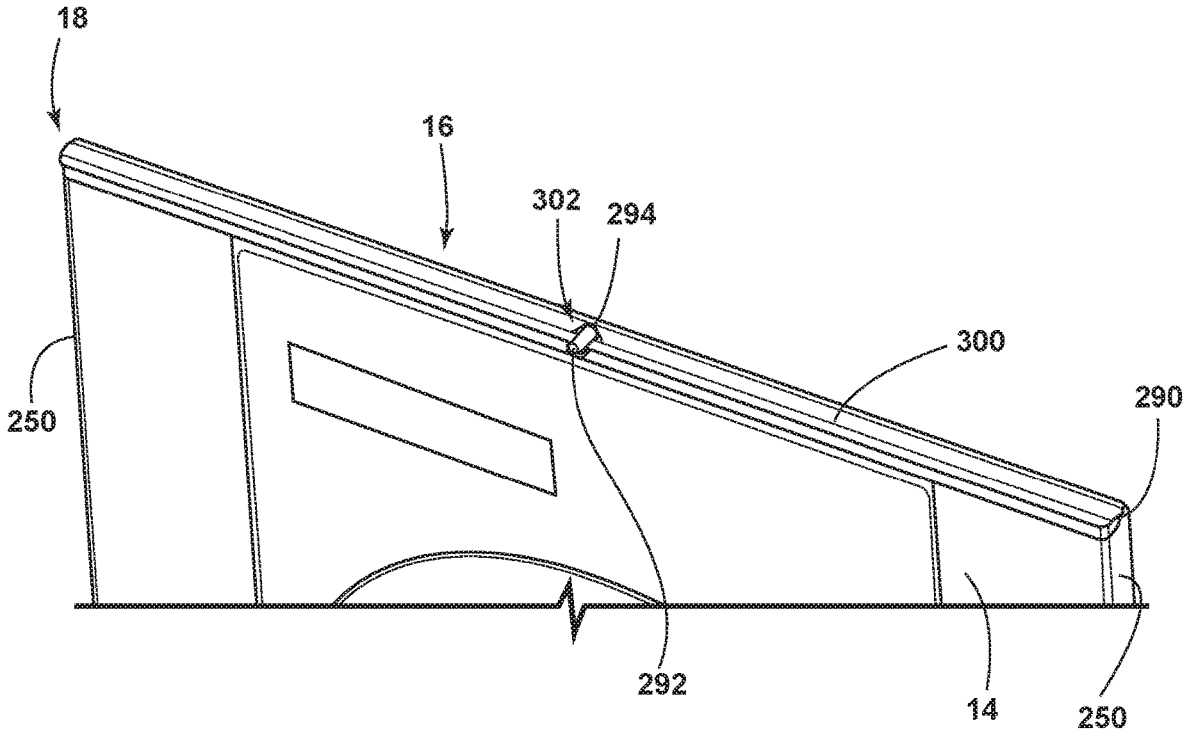
FIG. 27 is a cross-sectional view of the outer actuation buttons of FIG. 26, taken along line XXVII-XXVII, and showing actuation buttons at left and right sides of the cosmetic outer panel.

Referring now to FIGS. 26 and 27, an aspect of the intermediary interface 18 can include one or more actuation buttons 290 that are positioned alongside edges 250 of the outer panel 14 for the cosmetic outer structure 16. The actuation button 290 can be coupled with an actuation plunger 292 that is positioned within an interior surface 64 of the outer panel 14. When the actuation button 290 is pressed inward into the outer panel 14, a biasing surface 294 of the actuation button 290 engages the actuation plunger 292 and perpendicularly operates the actuation plunger 292 in an inward direction 114 and toward the user interface 10 of the concealed appliance 12. In various aspects of the device, the outer panel 14 can include opposing user actuation buttons 290 that are positioned on opposing edges 250 of the outer panel 14. Engagement of one or both of the actuation buttons 290 can cause a translation of the actuation plunger 292 towards the user interface 10 of the concealed appliance 12. By placing the actuation buttons 290 on opposing edges 250 of the outer panel 14, a single outer panel 14 can be manufactured and can be placed within the cosmetic outer structure 16 with either right hand or left hand hinges 94 so that a single outer panel 14 can be used among various cosmetic outer structures 16.

Referring again to FIG. 27, each actuation button 290 can include an elongated member 300 that includes the intermediary interface 18 that is exposed at each opposing edge 250 of the outer panel 14. The elongated member 300 extends through the outer panel 14 and to the angled biasing surface 294 of the actuation button 290 that engages a base 302 of the actuation plunger 292. As one or both of the actuation buttons 290 is pressed inward into the outer panel 14, the biasing surface 294 of each actuation button 290 slidably engages the base 302 of the actuation plunger 292 and the angled biasing surface 294 biases the actuation plunger 292 in the inward direction 114 from the interior surface 64 of the outer panel 14 and toward the user interface 10 for the concealed appliance 12.

While the actuation plunger 292 exemplified in FIG. 27 is centrally located within the outer panel 14, the actuation plunger 292 can be positioned at various locations within the outer panel 14. In an asymmetrically-positioned location of the actuation plunger 292, one of the elongated members 300 of the actuation buttons 290 may be longer than the other actuation button 290 to account for the actuation plunger 292 being positioned toward the left side or right side of the outer panel 14. This configuration allows the actuation plunger 292 to be positioned to coincide with a specific position of the desired portion of the user interface 10 for modifying the operating condition 46 of the appliance 12. As discussed above, it is typical that the actuation plunger 292 will be positioned to selectively engage a "pause" portion of the user interface 10.

According to various aspects of the device, multiple actuation buttons 290 can be positioned along opposing edges 250 of the outer panel 14. In such an embodiment, each set of opposing buttons 152 of the intermediary interface 18 can correspond to different actuation plungers 292 that are configured to engage various portions of the user interface 10 for the concealed appliance 12. Each actuation plunger 292 can be vertically and laterally positioned to directly engage a specific portion of the user interface 10 to accomplish various modifications to the operating condition 46 being performed by the concealed appliance 12.

As exemplified in FIGS. 26 and 27, each actuation button 290 is part of a rigid and elongated rod that can be laterally operated by an inward movement 74 of each actuation button 290 toward a central area of the outer panel 14. In various aspects of the device, each actuation button 290 can be coupled with a flexible member that can slidably operate within a tube member for engaging an actuation plunger 292 that may be positioned at a different vertical position within the outer panel 14. The actuation button 290 may also include one or more bends or other angled portions that can be configured to engage the actuation plunger 292 that is positioned at a different height within the outer panel 14 for the cosmetic outer structure 16.

Figure 28A:
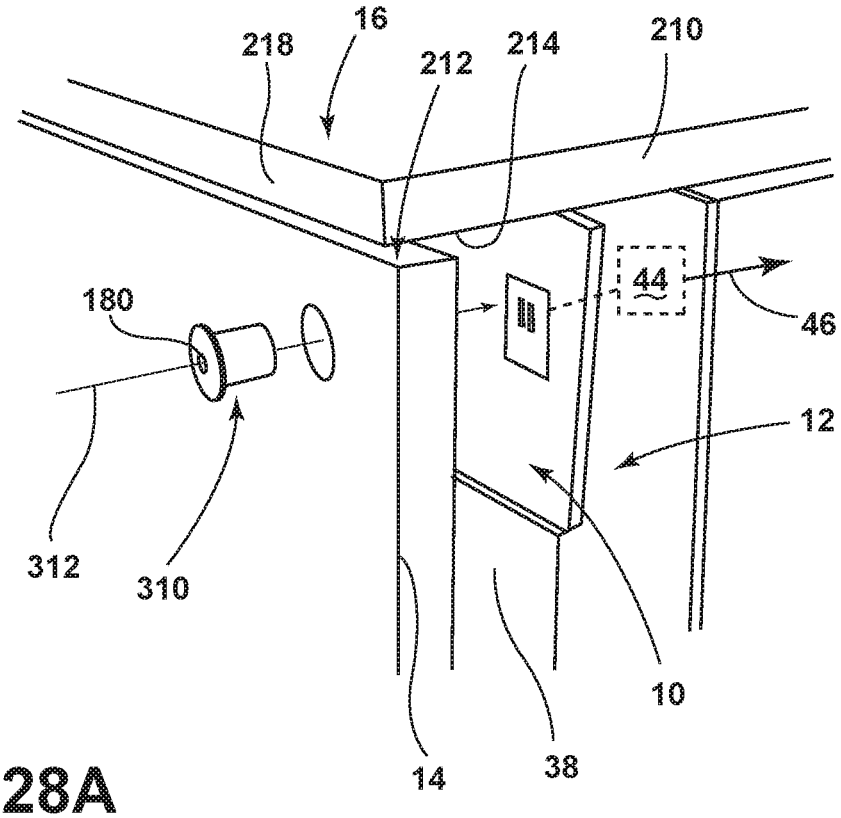
FIG. 28*a* is an exploded perspective view of a time-of-flight (TOF) actuator that is incorporated proximate an aspect of the cosmetic outer panel for engaging a user interface for an interior and concealed appliance.
Figure 28B:
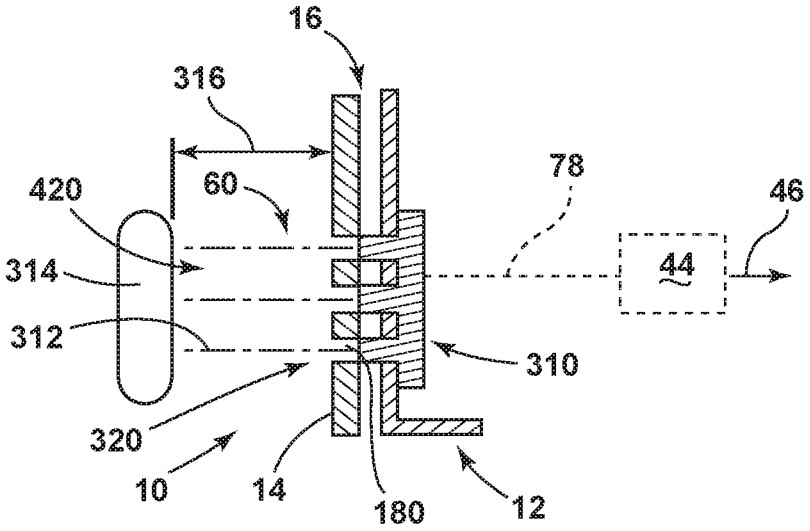
FIG. 28*b* is a cross-sectional view of an aspect of the TOF sensor that includes an array of sensors.

Referring now to FIGS. 28*a* and 28*b*, the intermediary interface 18 can include a wavelength of light, such as a laser 312 operated "time of flight" (TOF) sensor 310, that is located within the user interface 10 of the concealed appliance 12 and behind the outer panel 14 of the cosmetic outer structure 16. The outer panel 14 can include one or more openings 180 or substantially transparent or substantially translucent portions so that the lasers 312 of the TOF sensors 310 can pass through the interface section 60 or gesture sensing region 420, of the outer panel 14. A single TOF sensor 310 can be used, where interruption of the TOF sensor 310 by placing an obstruction 314 in front of the outer panel 14 can be indicative of a desire to modify the operating condition 46 of the concealed appliance 12. The TOF sensor 310 can be configured so that the operating condition 46 will be modified only when the obstruction 314 is within a certain predetermined range 316 or distance of the outer panel 14.

By way of example, and not limitation, placing an obstruction 314 against the exterior surface 112 of an outer panel 14 may not result in an activation of a signal 78 to modify the operating condition 46. Similarly, an obstruction 314 placed outside of the predetermined range 316 away from the outer panel 14, may also result in no signal 78 being sent to the controller 44 for modifying the operating condition 46. Alternatively, when the obstruction 314 is placed within the predetermined range 316 and, potentially, for a certain duration of time, the signal 78 can be sent from the TOF sensor 310 for the user interface 10 and to the controller 44 for modifying the operating condition 46 of the appliance 12.

In various aspects of the device, as exemplified in FIG. 28*b*, multiple TOF sensors 310 can be utilized in a linear configuration, or within an array 320 of TOF sensors 310. Using this array 320, each TOF sensor 310 corresponds to a distinct laser 312 that is emitted through an outer panel 14 for the cosmetic outer structure 16. Using this array 320 of TOF sensors 310, various gestures that are performed within a predetermined range 316 of distances from the outer surface 70 of the outer panel 14 can result in various respective commands or signals 78 being delivered through the user interface 10 for the appliance 12 and to the controller 44 for modifying the operating condition 46 for the concealed appliance 12.

By way of example, and not limitation, when the user swipes a hand in an upward direction within the proper distance range from the outer panel 14, this gesture may be indicative of a specific command being delivered to the controller 44. Swiping a hand downward may be indicative of a separate command or signal 78 being delivered to the controller 44. Accordingly, by moving an obstruction 314 over the array 320 of TOF sensors 310, each laser 312 can be sequentially interrupted by the movement of an object through the proper region in front of the outer panel 14 for communicating various information to the user interface 10 for the concealed appliance 12.

Referring again to FIGS. 28*a* and 28*b*, the TOF sensors 310 can be spaced apart from one another and each TOF sensor 310 can correspond to a separate opening 180 defined within the outer panel 14 for the cosmetic outer structure 16. In such an embodiment, the intermediary interface 18 can be controlled by placing a hand, finger or other obstruction 314 in front of a particular opening 180 corresponding to a respective TOF sensor 310. By covering or uncovering only one particular TOF sensor 310, that respective TOF sensor 310 provides a signal 78 to the controller 44 via the user interface 10, for modifying the operating condition 46 of the concealed appliance 12 in a particular desired manner.

Figure 29:
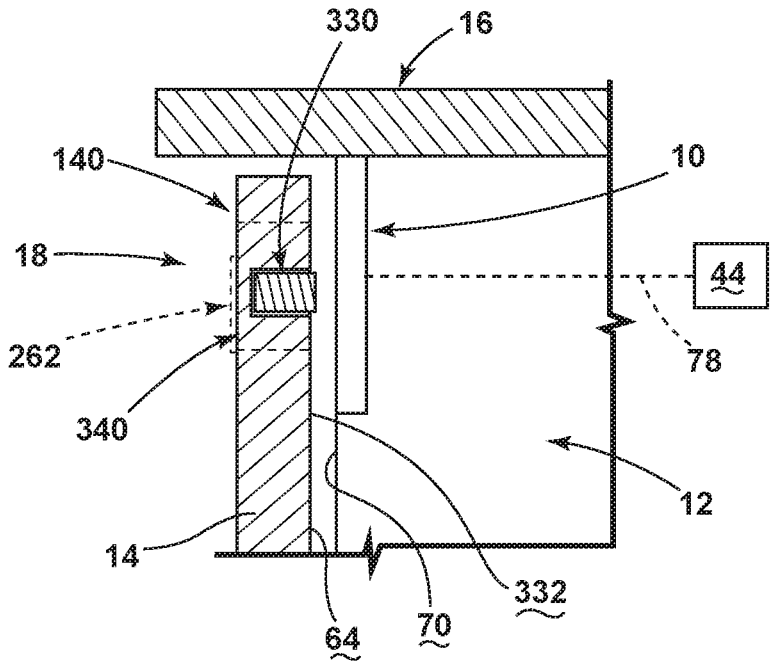
FIG. 29 is a cross-sectional view of a cosmetic outer panel and interior appliance and showing a deflecting portion of a cosmetic outer panel for engaging the user interface for the concealed appliance.

Referring now to FIG. 29, the intermediary interface 18 can be in the form of a wireless and electrically or magnetically operated sensor that is positioned within a backside 332 of the outer panel 14 for the cosmetic outer structure 16. This electrical sensor, which can be in the form of an inductive sensor 330, can operate according to a proximity from a portion of the user interface 10 for the concealed appliance 12. In this manner, the exterior surface 112 of the outer panel 14 can include a particular graphic or indicia 262 in the area of the inductive sensor 330. When the user presses that portion of the outer panel 14 in the inward direction 114, the inductive sensor 330 is moved towards the interface. Through this deflection of the outer panel 14, the user interface 10 and the inductive sensor 330 cooperatively engage one another and the user interface 10 is instructed to provide a signal 78 to the controller 44 for modifying an operating condition 46 for the concealed appliance 12. Where the inductive sensor 330 is used, movement of the inductive sensor 330 for the outer panel 14 in an inward direction 114 and toward the user interface 10 generates an inductive current within one or both of the user interface 10 and the intermediary interface 18. Various electromagnetic fields can also be generated that are indicative of an instruction being sent to the controller 44 by the user interface 10.

In various aspects of the device, the outer panel 14 can include multiple inductive sensors 330 that are disposed within a backside 332 of the outer panel 14. Where the outer panel 14 is a substantially rigid member such as a panel made of wood, metal, or other substantially rigid material, the inductive sensors 330 are typically positioned far from one another so that each individual inductive sensor 330 can be manipulated individually to inductively engage a portion of the user interface 10 for the concealed appliance 12. In various aspects of the device, the outer panel 14 can include integral deflecting portions 340 that may be made of an inner portion of the outer panel 14 or a different material, such as a deflecting insert, that is inlaid within the outer panel 14. These distinct deflecting portions 340 of the outer panel 14 can correspond to separate inductive sensors 330 that can be depressed or deflected inward and toward a respective portion of the user interface 10. Each respective inductive sensor 330 can engage a different portion of the user interface 10 for the concealed appliance 12 for providing corresponding signals 78 to the controller 44, via the user interface 10, for providing different commands for an operating condition 46 for the concealed appliance 12.

Figure 30:
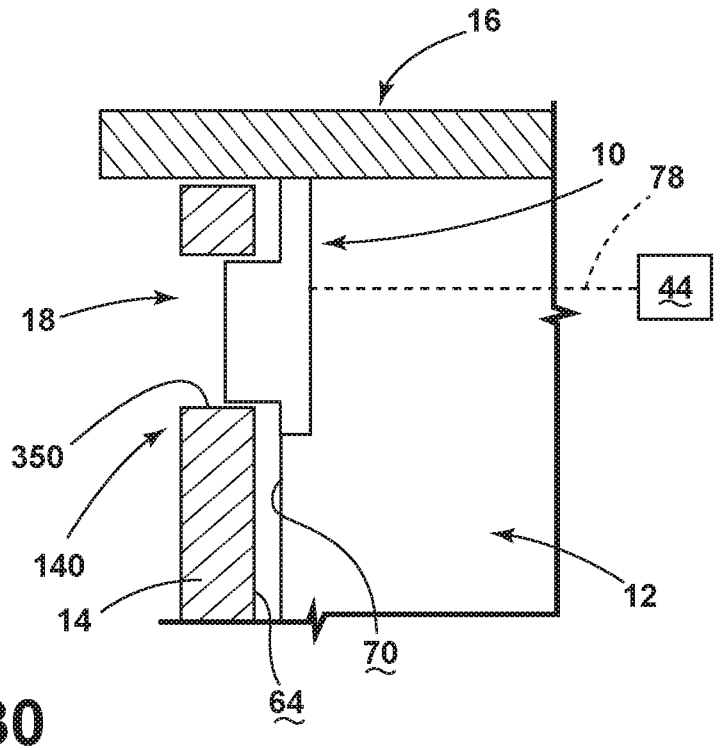
FIG. 30 is a cross-sectional view of a cosmetic outer panel and concealed appliance showing an aperture within the cosmetic outer panel for directly engaging the user interface for the concealed appliance.

Referring now to FIG. 30, the outer panel 14 can include an access aperture 350 that is defined within and potentially through the outer panel 14. In such an embodiment, a portion of the user interface 10 for the concealed appliance 12 can be positioned to protrude at least partially through the access aperture 350 defined within the outer panel 14. Where the portion of the user interface 10 protrudes through the access aperture 350 of the outer panel 14, the user can access that portion of the user interface 10 for delivering a signal 78 to the controller 44 to modify the operating condition 46. Typically, this configuration will include buttons 152 of the user interface 10 protruding through portions of the access aperture 350 of the outer panel 14. It is also contemplated that dials 374, and other deflectable, laterally operable or rotationally operable portions of the user interface 10 may also protrude partially through the access aperture 350 defined within the outer panel 14 for the cosmetic outer structure 16.

According to various aspects of the device, where portions of the user interface 10 may protrude into and partially through the access aperture 350 defined within the outer panel 14 for a cosmetic outer structure 16, the outer panel 14 may include a pattern or arrangement 320 of aesthetic features that may be used to hide, distort, obfuscate, or camouflage the presence of the user interface 10 protruding into the outer panel 14. Such a pattern may be in the form of a visual arrangement of applied features that may be similar in shape and/or color to the portion of the user interface 10 that is visible through the access aperture 350 of the cosmetic outer structure 16. Accordingly, the visual aesthetic of the outer panel 14 can be used to obfuscate the presence of portions of the user interface 10 for the concealed appliance 12 that may be visible from the front of the cosmetic outer structure 16.

Figure 31:
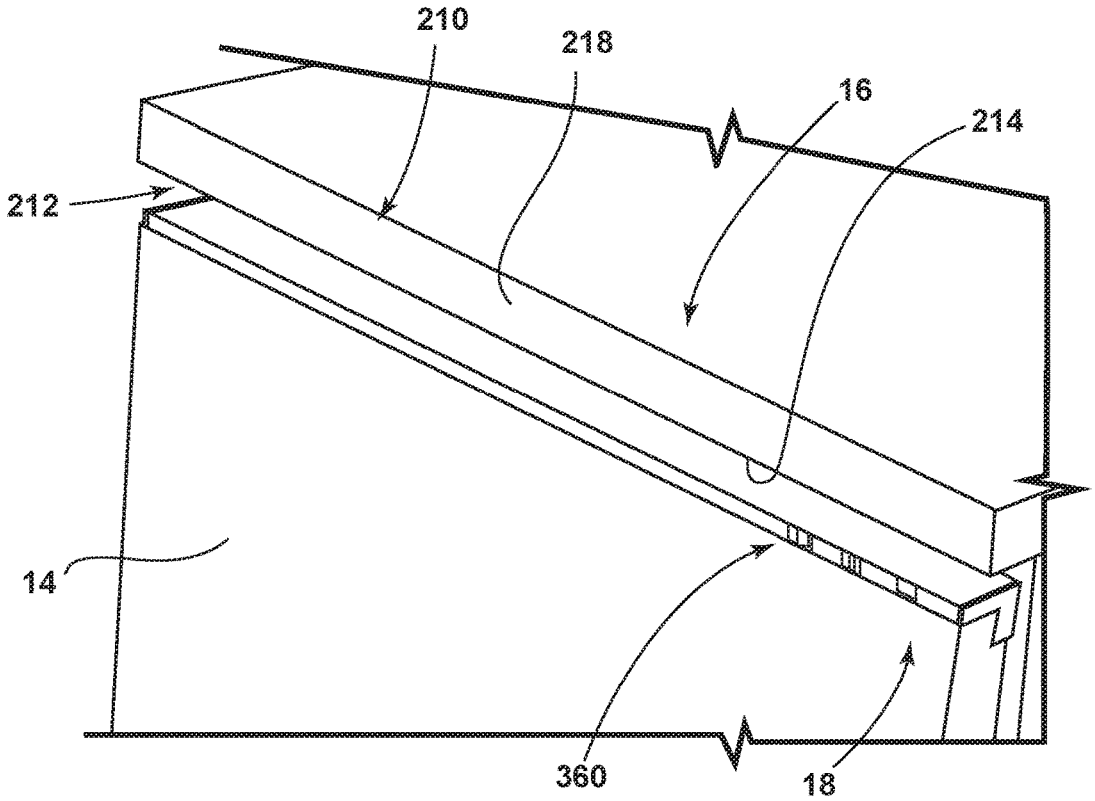
FIGS. 31 and 32 illustrate various views of a cosmetic outer panel that incorporate illuminated portions of the cosmetic outer panel that can be engaged for directly or indirectly engaging the user interface of the concealed appliance.
Figure 32:
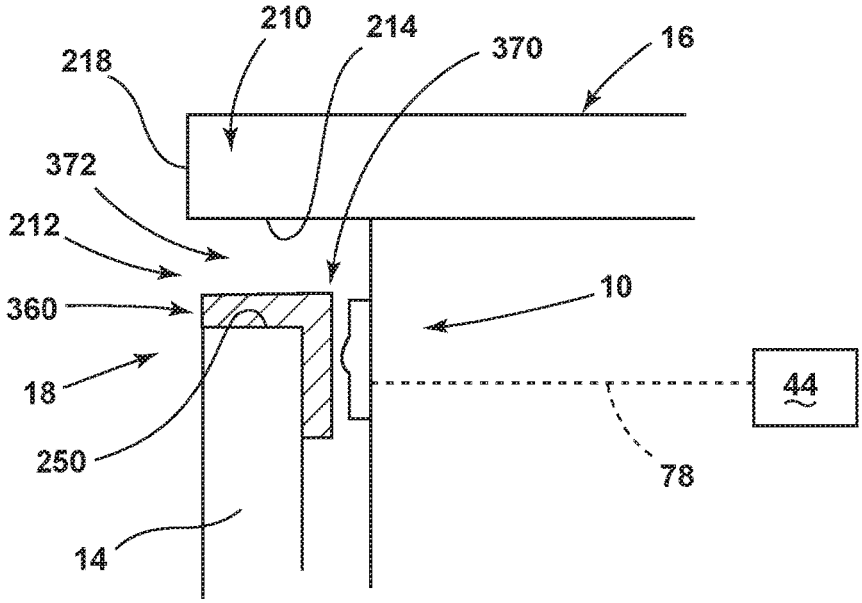

Referring now to FIGS. 31 and 32, the intermediary interface 18 can include one or more deflecting portions 340 of the outer panel 14 that can be deflected in an inward direction 114 and toward the user interface 10 for the concealed appliance 12. In such an embodiment, the outer panel 14 may include a light guide 360 or illuminated feature along an edge 250 of the outer panel 14. This illuminated light guide 360 of the intermediary interface 18 can correspond to various selectable commands that can be delivered to the controller 44 via the user interface 10. The light guide 360 for the intermediary interface 18 can include various indicia 262 that can correspond to specific commands, such as "stop," "pause," "start," "lock," "unlock" and other similar laundry-processing functions 222 that may be conveniently activated or deactivated via the outer panel 14 for the cosmetic outer structure 16.

Where the light guide 360 is utilized within the outer panel 14, the electricity may be delivered to the outer panel 14 for powering the various features of the light guide 360. In such an embodiment, the light guide 360 can include an inductive or capacitive feature for engaging portions of the user interface 10 for the concealed appliance 12. Where various inductive or capacitive features are used within the light guide 360 for the outer panel 14, when the outer panel 14 is moved in the inward direction 114 and toward the user interface 10, the inductive or capacitive connection between the intermediary interface 18 and the user interface 10 can be activated without any direct physical contact between the outer panel 14 and the user interface 10. In various aspects of the device, the illuminated features of the light guide 360 can be generated by light from the user interface 10 passing through a light guide 360 that is positioned at an edge 250 of the outer panel 14. By engaging portions of the illuminated light guide 360, portions of the outer panel 14 can be moved into direct or indirect engagement with the user interface 10.

Where no electrical wiring is desired to be placed within the outer panel 14, magnets or a ferromagnetic material 370 can be positioned at various portions of the outer panel 14. These magnets or ferromagnetic portions of the outer panel 14 can be used to provide an electromagnetic and/or magnetic engagement between the outer panel 14 and the user interface 10. This magnetic or electro-magnetic engagement can initiate the delivery of the signal 78 to the controller 44 for modifying the operating condition 46 for the concealed appliance 12.

Referring again to FIGS. 31 and 32, the light guide 360 that is positioned on the outer panel 14 can at least partially wrap around to the backside 332 of the outer panel 14. The portion of the light guide 360 that is positioned at the back side of the outer panel 14 can include the capacitive engaging features or can include the magnets or the ferromagnetic material 370 that can be used to activate or otherwise engage portions of the interface for the concealed appliance 12.

According to various aspects of the device, where the light guide 360 has been incorporated within a portion of the outer panel 14, such as the upper edge 250, the user interface 10 and/or a portion of the light guide 360 can include a pressure sensor 90 that can be utilized in connection with the light guide 360 to provide a signal 78 to the controller 44. In such an embodiment, the pressure sensor 90 can be used where a portion of the light guide 360 is deflected towards the user interface 10 for the concealed appliance 12 and directly engages the user interface 10. The pressure sensor 90 can be used to receive a predetermined amount of pressure 100, a predetermined duration of pressure 100, or a predetermined pattern of pressures 100 as the user depresses or otherwise deflects a portion of the light guide 360 towards the user interface 10 for the concealed appliance 12.

According to various aspects of the device, the user interface 10 for the concealed appliance 12 can include an inductive portion 380 that can engage a portion of the light guide 360. When the light guide 360 is positioned in the active state 140 near the user interface 10, the inductive portion 380 of the user interface 10 delivers inductive power, via the inductive sensor 330, into the light guide 360 for powering the various light fixtures within the light guide 360. Accordingly, utilizing this aspect of the device, no hard-wired electrical power is delivered to the outer panel 14 for activating or operating the light guide 360. It is also contemplated that a light guide 360 can be a replaceable fixture that can be switched out according to the preferences of the user. Such light guides 360 can include different light fixtures or different lighting placement or patterns that can be customizable depending upon the preferences of the user.

Referring again to FIGS. 31 and 32, the light guide 360 can include a series of light fixtures that can be activated, deactivated, modified to provide various patterns that can be for aesthetic purposes or can be used to provide the user with various information concerning the operating condition 46 of the appliance 12 or a particular status of the appliance 12. The light guide 360 can also be used to highlight an area within the gap 212 between the outer panel 14 and the top panel 210 of the cosmetic outer structure 16. This highlighted area within the gap 212 of the cosmetic outer structure 16 can be used as a gesture area 372 within which a user can move their hand or other obstruction 314 to engage a gesture-activated intermediary interface 18 for the cosmetic outer structure 16.

Figure 33:
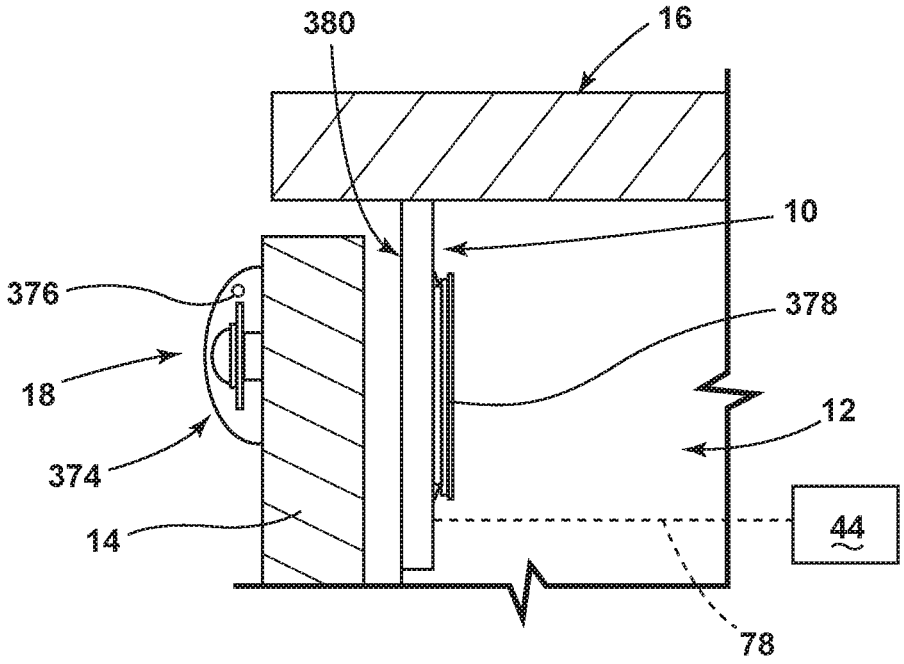
FIG. 33 is a cross-sectional view of a cosmetic outer panel and interior concealed appliance showing an exterior dial mounted to the cosmetic outer panel that includes a wireless communication system for accessing the user interface for the concealed appliance.
Figure 34:
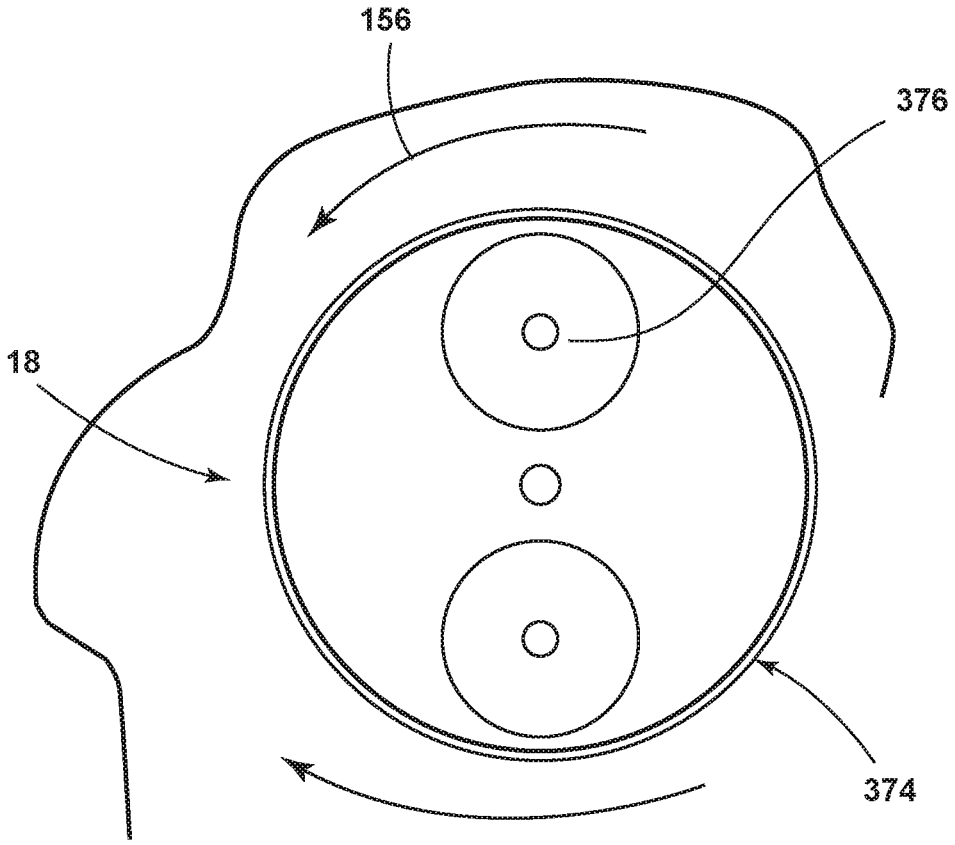
FIG. 34 is a schematic diagram illustrating an aspect of the wirelessly-operating dial having one or more radio-frequency identification (RFID) tags incorporated therein.

Referring now to FIGS. 33 and 34, the outer panel 14 and the user interface 10 can cooperate using RFID, near field communication (NFC), proximity sensors, reed switches, or other similar magnetic switches to provide signals 78 to the controller 44 for modifying the operation condition of the concealed appliance 12. In various aspects of the device, a rotary dial 374 can be disposed on the outer panel 14 for the cosmetic outer structure 16. As the rotary dial 374 is operated, various RFID tags 376 or various other similar positioning sensors or positioning switches can be operated in relation to various corresponding tags that are disposed within the user interface 10 of the concealed appliance 12.

By way of example, and not limitation, a dial 374 positioned on the outer surface 70 of the outer panel 14 can include various RFID tags 376. As the dial 374 is rotated, these RFID tags 376 can change position with respect to an RFID reader antenna 378 that is positioned within the user interface 10 for the concealed appliance 12. Accordingly, rotation of the RFID dial 374 to a particular position or location can correspond to the user interface 10 providing a predetermined signal 78 to the controller 44. The dial 374 can include multiple RFID tags 376 that can correspond to specific signals 78 to be sent to the controller 44 by the user interface 10.

In various aspects of the device, the RFID dial 374 can be a fixture that is attached, adhered, or otherwise disposed in the outer surface 70 of the outer panel 14. Multiple RFID tags 376 are typically embedded within the dial 374 in a position near the RFID reader antenna 378 within the user interface 10. In an exemplary condition, the dial 374 can include three RFID tags 376 and correspond to "pause," "start" and "stop" commands that can be delivered to the controller 44 for modifying the operating condition 46 of the concealed appliance 12. According to various aspects of the device, the RFID tags 376 within the knob 154 are static in nature and do not require electrical power. The RFID reader antenna 378 within the user interface 10 for the appliance 12 is powered and monitors the positioning of each RFID tag 376 within the knob 154. Accordingly, using this device, there would be no need to deliver electrical power through the outer panel 14 of the cosmetic outer structure 16.

Figure 35:
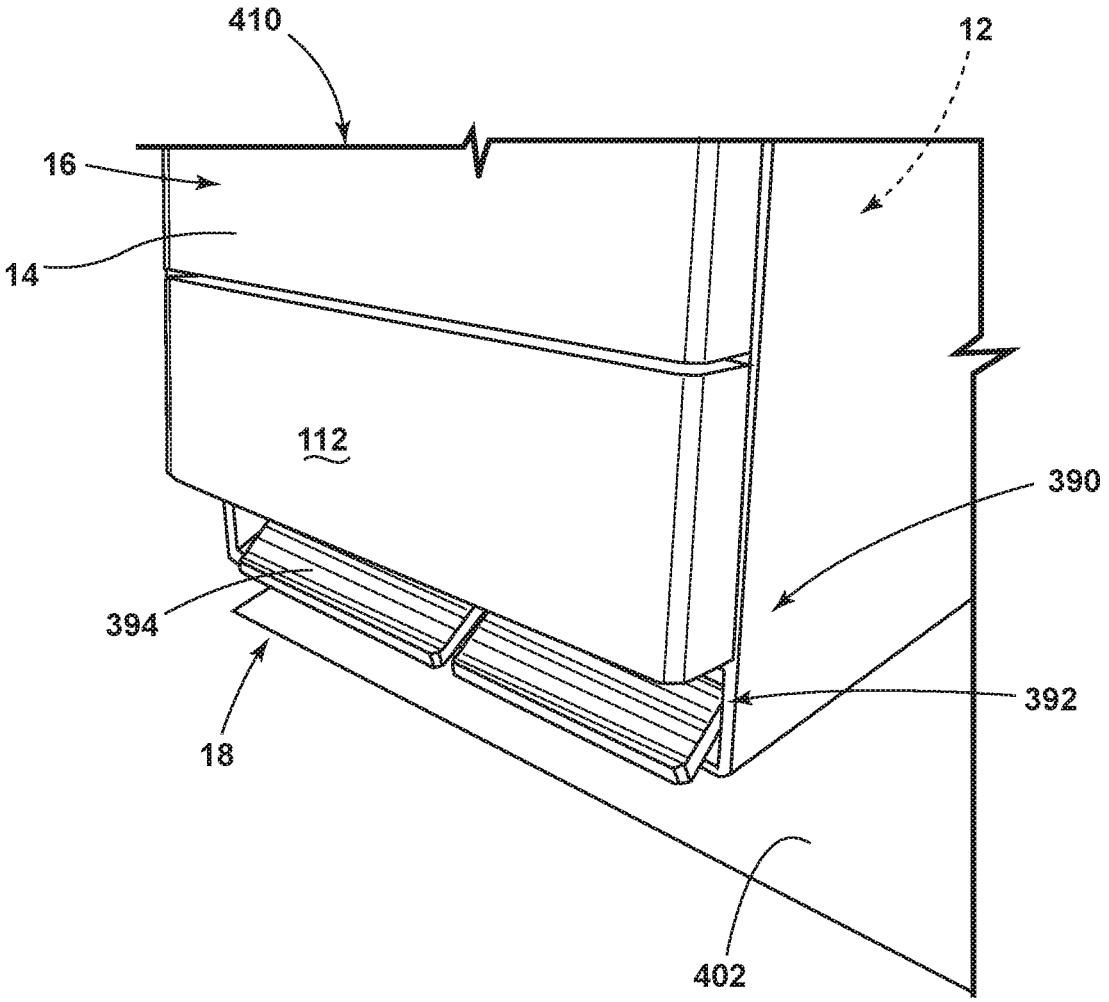
FIG. 35 is a front perspective view of a cosmetic outer panel for surrounding a concealed appliance and incorporating foot pedals for accessing a user interface for a concealed appliance.
Figure 36:
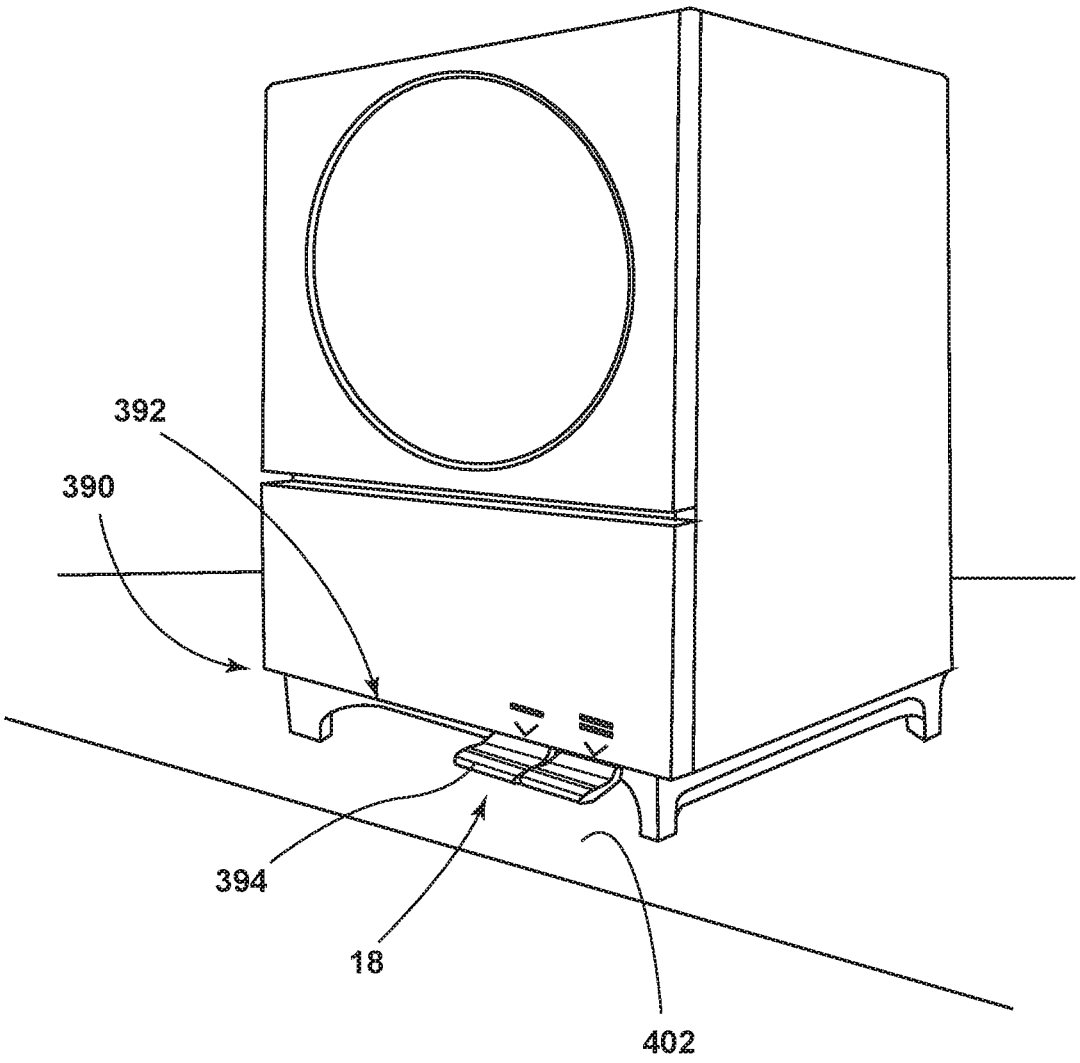
FIG. 36 is a front perspective view of a cosmetic outer panel for surrounding a concealed appliance and incorporating foot pedals for accessing a user interface for a concealed appliance.
Figure 37:
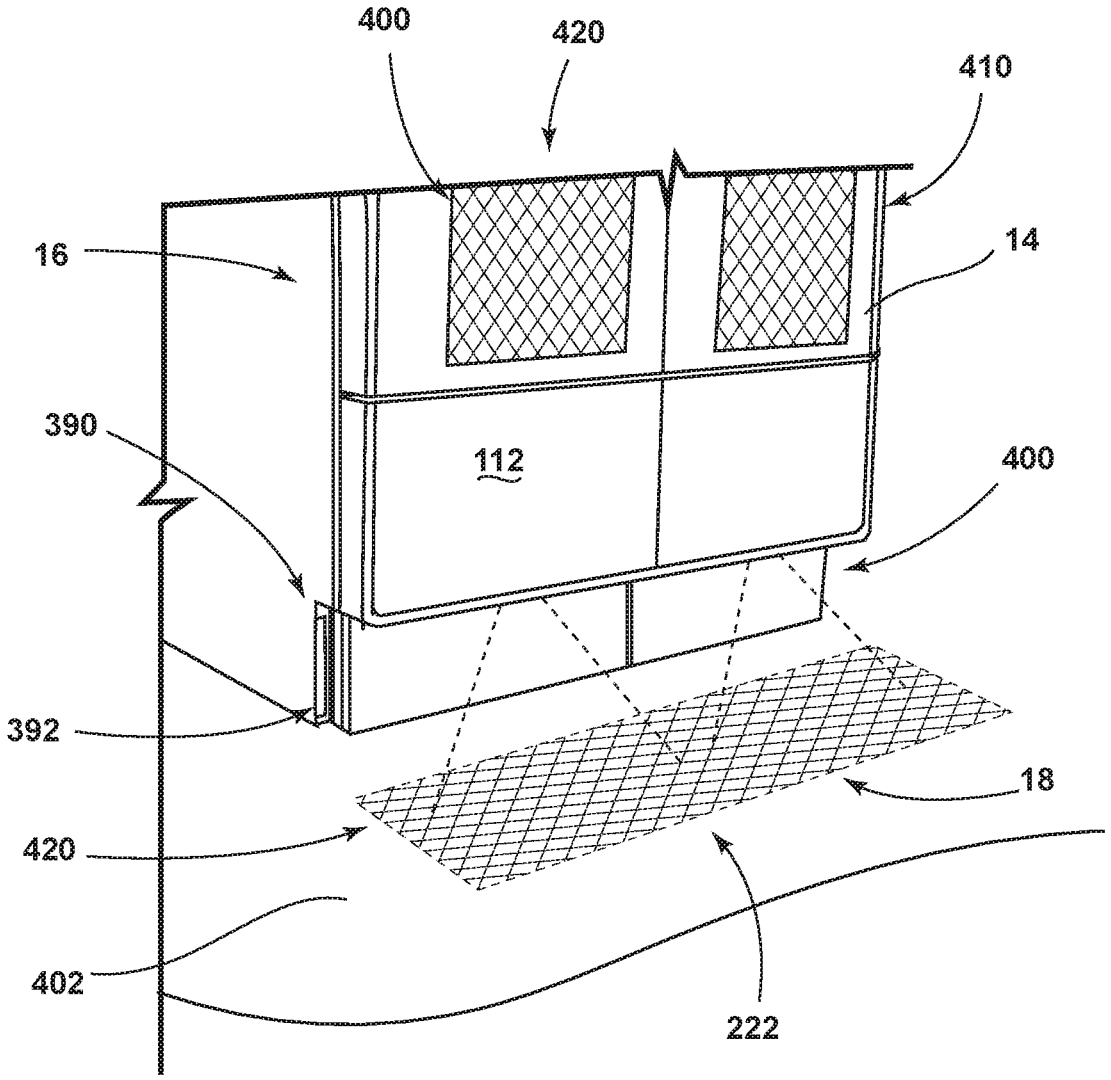
FIG. 37 is a front perspective view of an appliance incorporating a foot-operated gesture interface for accessing a user interface for the concealed appliance.
Figure 38:
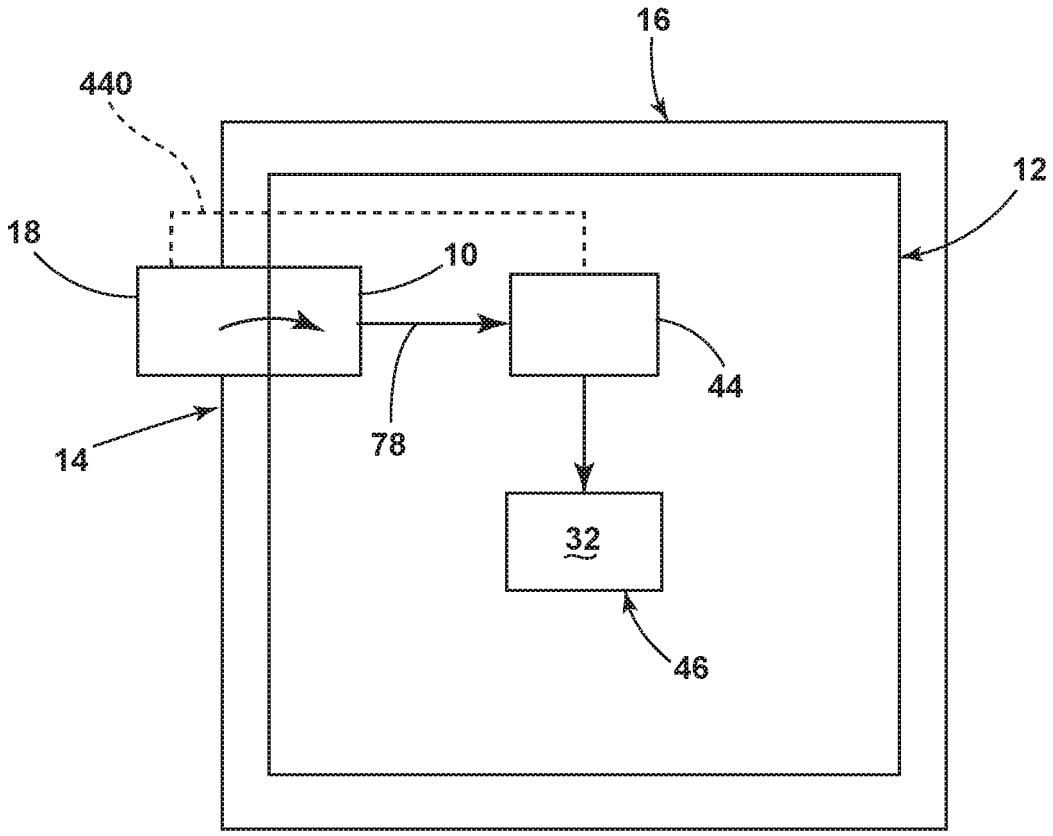
FIG. 38 is a schematic diagram showing operation of the intermediary interface.

Referring now to FIGS. 35-37, a bottom portion 390 of the cosmetic outer structure 16 can include an opening 180 through which various controls can extend. These controls can be positioned within a toe kick 392 for the cosmetic outer structure 16. Typically, the toe kick 392 is positioned at the bottom of the cosmetic outer structure 16 and is recessed inward from the exterior surface 112 of the outer panel 14. Within the toe kick 392, the intermediary interface 18 can include one or more foot pedals 394 that can be pushed for selectively engaging the user interface 10 for providing a signal 78 to the controller 44. Various indicia 262 can be positioned on the exterior surface 112 of the outer panel 14 that corresponds to the particular laundry-processing function 222 that each foot pedal 394 operates. These foot pedals 394 can be large in size or can be smaller pedals 394 that are positioned to one side of the cosmetic outer structure 16. Where the foot pedals 394 are used, activation of the foot pedal 394 can deliver a signal 78 to the user interface 10 through a mechanism that extends upward to the user interface 10 for the concealed appliance 12. It is also contemplated that each foot pedal 394 can be manufactured as part of the appliance 12 and can deliver a signal 78 directly to the controller 44 or to the controller 44 via the user interface 10.

As exemplified in FIG. 37, instead of physical pedals 394 that are located within the toe kick 392 of the cosmetic outer structure 16, the appliance 12 and/or the cosmetic outer structure 16 can project an interactive projection 400 onto the floor 402 within and in front of the toe kick 392 for the appliance 12. The interactive projection 400, similar to a TOF sensor 310, allows a user to interrupt the projection before it reaches the floor 402. Such an interruption results in a signal 78 being delivered to the controller 44 indicative of modifying the operating condition 46 for the concealed appliance 12. The interactive projection 400 can be multiple separate projections that can correspond to different command signals 78 that can be delivered to the controller 44. As with the light guide 360 described above, the various interactive projections 400 displayed on the floor 402 can be customizable to the user's preference. These interactive projections 400 can also be configured to only provide signal 78 after this projection has been interrupted for a predetermined duration of time. In such an embodiment, an inadvertent or very brief interruption of the projection will result in no signal 78 being sent to the controller 44. Similarly, the interactive projection 400 can be configured to only set the signal 78 after the projection has been interrupted and then resumed within a predefined period of time. In such an embodiment, where a user stands in the front of the appliance 12 for an extended period of time (more than one minute, for example), no signal 78 will be delivered. Where the user places a foot in the projection and then removes it after a predefined period of time (between two seconds and thirty seconds, for example), the signal 78 will be sent. The interactive projection 400 can also be configured to send the signal 78 once the projection is interrupted by an obstruction 314, such as a user's foot.

According to various aspects of the device, the interactive projection 400 can be displayed on the floor 402 or on a front portion 410 of the appliance 12, such as the exterior surface 112 of the outer panel 14. Where the interactive projection 400 is displayed on the outer panel 14, the interactive projection 400 can originate from the underside 214 of the top panel 210 and can project downward. In this instance, various interactive projections 400 that correspond to the desired laundry-processing functions 222 can be displayed on the outer panel 14. Interruption of any one of these interactive projections 400 can result in a signal 78 being delivered to the controller 44 that corresponds to the respective projection that has been interrupted.

Referring again to FIGS. 28 and 35-37, various gestures or hand movements can be used to engage the intermediary interface 18 for delivering a signal 78 to the controller 44 via the user interface 10 of the concealed appliance 12. The space utilized for communicating these gestures can be a gesture sensing region 420 that is located in the front of the outer panel 14, within the gap 212 between the outer panel 14 and the top panel 210, near the toe kick 392 at the bottom of the cosmetic outer structure 16, in front of or above the top panel 210, and in other locations surrounding the cosmetic outer structure 16.

Where the gesture sensing region 420 is positioned within the gap 212 between the outer panel 14 and the top panel 210, a sensor, such as TOF sensor 310, ultrasonic sensor, positioning sensor, or other similar obstruction-detecting sensor can be located within the user interface 10 of the concealed appliance 12. When the user places their hand within the gap 212 or moves their hand through the gap 212 in a predetermined motion, the user interface 10 can detect this gesture. Depending upon the motion perceived by the user interface 10, a signal 78 can be sent to the controller 44 that corresponds to a particular modification of the operating condition 46 for the concealed appliance 12.

According to various aspects of the device, the user can interact with the outer panel 14 or a portion of the cosmetic outer structure 16 by knocking on the surface of the cosmetic outer structure 16. Typically, a user can knock on the top panel 210 or the exterior surface 112 of the outer panel 14 in a predetermined configuration of knocks or taps. This predetermined configuration of knocks or taps can correspond to a signal 78 being delivered from the user interface 10 to the controller 44. These knocks or taps can be perceived by a microphone, vibration sensor, or other similar detecting mechanism located within the user interface 10 for the concealed appliance 12. It is contemplated that a combination of knocks that correspond to a particular command being delivered to the controller 44 can be customizable. By way of example, and not limitation, the intermediary interface 18 can be set to shut off the appliance 12 upon three rapid knocks on the top panel 210 or outer panel 14 for the cosmetic outer structure 16.

In various aspects of the device, intermediary interface 18 can utilize a voice-activated sensor that can detect voice commands from the user for providing various signals 78 to the controller 44 for modifying the operating condition 46 of the concealed appliance 12. The voice recognition sensor can be calibrated to respond to a particular user's voice or a group of user's voices for performing various laundry-processing functions 222.

Figure 4:
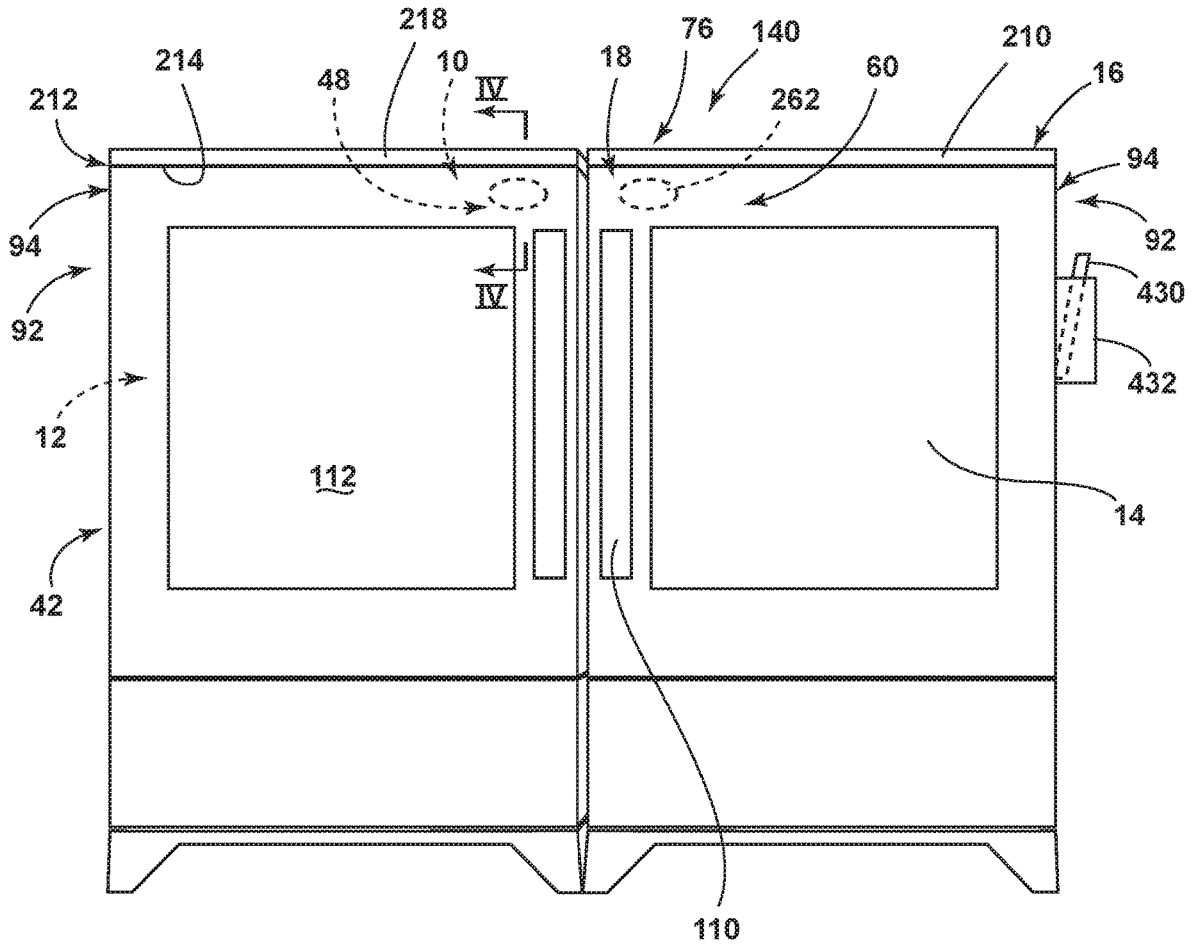
FIG. 4 is a front perspective view of a side-by-side appliance pair that includes the cosmetic outer structure.

According to various aspects of the device, the intermediary interface 18 can be in the form of a separate remote control 430 that can be mounted to an exterior surface 112 of the cosmetic outer panel 14 (shown in FIG. 4). This remote control 430 can be utilized for wirelessly communicating to the user interface 10 for the concealed appliance 12. Where a remote control 430 is used, the wider range of laundry-processing functions 222 that can be controlled from the outside of the cosmetic outer structure 16 may be available to the user. Such a remote control 430 may be disposed within a housing 432 or smaller accessory container can be attached or incorporated within a wall of the cosmetic outer structure 16.

According to the various aspects of the device as exemplified in FIGS. 1-37, the various commands delivered via the user interface 10 via the intermediary interface 18 can include simple commands such as "stop," "pause," "start," "lock" and "unlock." These commands can be indicative of a motor start function 450, motor stop function 452 and a motor pause function 454, as exemplified in FIGS. 24 and 25. Typically, these commands are relatively common commands that are frequently used and allow the user to initiate basic laundry-processing functions 222 without needing to open the outer panel 14 for the cosmetic outer structure 16. More complex commands such as selecting a laundry cycle, changing a laundry cycle, and setting various parameters of the laundry cycle can also be incorporated within the intermediary interface 18. Where basic commands are used, it is contemplated that a single stop function, such as an emergency stop function 440 (shown in dashed line in FIG. 38), can be configured to be delivered directly from the intermediary interface 18 and to the controller 44 without providing a signal 78 to the user interface 10 for the concealed appliance 12. Such an emergency stop can be readily accessible to the user. While being readily accessible, the emergency stop function 440 is also at least partially concealed within the cosmetic outer structure 16 having the appearance of furniture or cabinetry within a residence. According to various aspects of the device, the intermediary interface 18 can include direct physical contact with the user interface 10 for the concealed appliance 12. Wireless connectivity via RFID, NFC, Bluetooth, proximity sensors, various magnetic sensors, and other wireless communicating mechanisms can be incorporated where the intermediary interface 18 does not come into direct physical contact with the user interface 10 for the concealed appliance 12.

According to various aspects of the device, the cosmetic outer structure 16 can be used to conceal various appliances 12. Such appliances 12 can include, but are not limited to, washers, dryers, refrigerators, dishwashers, garbage disposals, hot water heaters, and other similar appliances 12 that may be positioned within typical living spaces of the residence. In smaller residences, such as apartments, the use of the cosmetic outer structure 16 surrounding a particular appliance 12 is desirable where a small apartment may not include a dedicated laundry room or utility space. Accordingly, the use of the intermediary interface 18 for engaging the concealed appliance 12 without opening the cosmetic outer structure 16 is also desired for expedient access to at least some of the controls for the concealed appliance 12.

Referring generally to FIGS. 1-37, the cosmetic outer structure 16 for concealing the appliance 12 can be a manufactured piece that is made along with or substantially contemporaneously with the concealed appliance 12. Alternatively, the options for the intermediary interface 18 described herein can be manufactured or produced after market by a cabinet maker, millwork manufacturer, contractor, home owner, or other individual that may be tasked with concealing an aspect of the cosmetic outer structure 16. According to various aspects of the device, the user interface 10 for the appliance 12 is manufactured to operate in conjunction with one or more of the intermediary interfaces 18 described herein. Accordingly, where the intermediary interface 18 utilizes a pressure sensor 90 disposed within the user interface 10 for the appliance 12, the pressure sensor 90 is manufactured within the user interface 10 for the appliance 12. Also, where one or more TOF sensors 310, RFID, MPC, magnetic sensor or other similar interface are utilized for operating the intermediary interface 18, the various sensors are typically manufactured within the user interface 10. The individual or manufacturer producing the cosmetic outer structure 16 can manufacture the outer panel 14 to position the necessary openings 180, deflecting portions 340, buttons 152, brackets 252, plungers 132, knobs 154, or other mechanisms for directly engaging the user interface 10 for the concealed appliance 12 within the cosmetic outer structure 16.

According to another aspect of the present disclosure, a laundry appliance includes a body that houses a motor that selectively operates at least one of a drum and a blower for processing laundry within the drum. The body includes an aperture for selectively accessing the drum. A door panel provides selective access to the aperture. A user interface is in communication with a controller for selecting a laundry-processing function to be performed via operation of the motor. A cosmetic outer structure at least partially conceals the body from view. The cosmetic outer structure includes an outer panel and a top panel. An outer selector is positioned proximate the outer panel, wherein the outer selector is in communication with the controller via the user interface.

According to another aspect, the outer panel is incorporated with the door panel.

According to yet another aspect, the outer selector physically cooperates with the user interface to selectively operate the motor.

According to another aspect, the outer selector and the user interface are configured to cooperate to selectively initiate at least one of a motor start function, a motor stop function and a motor pause function.

According to yet another aspect, the outer selector is configured to selectively operate the door panel between a locked position and an unlocked position.

According to another aspect, the outer selector is operable between an idle state and an active state, wherein the outer selector is in physical contact with the user interface at least in the active state.

According to yet another aspect, the outer selector includes an aperture through which the user interface is accessible for defining the active state.

According to another aspect, the outer selector includes at least one intermediary interface that extends through the aperture.

According to yet another aspect, the intermediary interface is laterally operable within the aperture and selectively engages a pressure-sensitive switch of the user interface.

According to another aspect, the outer selector includes a knob that is rotationally operable relative to the user interface, wherein rotation of the knob defines a corresponding lateral movement of the intermediary interface.

According to yet another aspect, the intermediary interface is a plunger that is coupled with a handle of the outer panel.

According to another aspect, the aperture is defined between the outer panel and a top panel of a cosmetic outer structure, wherein the top panel is positioned over the body.

According to yet another aspect, the outer selector is at least partially defined by a deflecting portion of the outer panel.

According to another aspect of the present disclosure, a laundry appliance includes a body that houses a motor that selectively operates at least one of a drum and a blower for processing laundry within the drum. The body includes an aperture for selectively accessing the drum. A door panel provides selective access to the aperture. A user interface is in communication with a controller for selecting a laundry-processing function to be performed via operation of the motor. A cosmetic outer structure at least partially conceals the body from view. The cosmetic outer structure includes an outer panel and a top panel. An outer selector is positioned proximate the outer panel, wherein the outer selector is in communication with the controller via the user interface.

According to another aspect, the outer selector is defined by a handle of the cosmetic outer structure, and wherein the user interface includes a pressure-sensitive switch that receives a portion of the handle.

According to yet another aspect, the outer selector includes a sliding gap selector that is positioned within a gap defined between the top panel and the outer panel of the cosmetic outer structure, and wherein the sliding gap selector includes a plurality of gap selectors that correspond to a motor start function, a motor stop function and a motor pause function, respectively.

According to another aspect, the outer selector is at least partially defined by a deflecting portion of the outer panel, wherein the deflecting portion includes a deflecting insert that is positioned within the outer panel, wherein the deflecting insert is made of a different material than a remainder of the outer panel.

According to another aspect of the present disclosure, a laundry appliance includes a body that houses a motor that selectively operates at least one of a drum and a blower for processing laundry within the drum. The body includes an aperture for selectively accessing the drum. A door panel provides selective access to the aperture. A user interface is in communication with a controller for selecting a laundry-processing function to be performed via operation of the motor. A cosmetic outer structure at least partially conceals the body from view. The cosmetic outer structure includes an outer panel and a top panel. A gesture sensing region is defined proximate the outer panel. The gesture sensing region is configured to wirelessly interact with the user interface when an obstruction engages the gesture sensing region.

According to another aspect, the gesture sensing region is an area proximate an exterior surface of the outer panel, wherein a wavelength of light is transmitted through the gesture sensing region and selective interruption of at least a portion of the wavelength of light generates an instruction from the user interface to the controller for operating the motor.

According to yet another aspect, wherein the wavelength of light is a laser that is transmitted through an opening defined within the outer panel.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body 30 with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connectors or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions 46, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above are merely for illustrative purposes and not intended to limit the scope of the device, which is defined by the following claims as interpreted according to the principles of patent law, including the Doctrine of Equivalents.

What is claimed is:

1. A laundry appliance comprising:

a body that houses a motor that selectively operates a drum for processing laundry, wherein the body includes a front panel defining an aperture for selectively accessing the drum;

a door panel that is attached to the body and provides selective access to the aperture;

a controller configured to operate at least the motor;

a user interface that is attached to the body and is in communication with the controller for selecting a laundry-processing operation to be performed;

an outer panel that selectively conceals the door panel, the front panel and the user interface from view; and an outer selector positioned on the outer panel, wherein the outer selector is in communication with the controller via the user interface, and wherein the outer selector on the outer panel physically cooperates with the user interface to selectively operate the motor.

2. The laundry appliance of claim 1, wherein the outer panel is incorporated with the door panel.

3. The laundry appliance of claim 1, wherein the outer selector and the user interface are configured to cooperate to selectively initiate at least one of a motor start function, a motor stop function and a motor pause function.

4. The laundry appliance of claim 1, wherein the outer selector is configured to selectively operate the door panel between a locked position and an unlocked position.

5. The laundry appliance of claim 1, wherein the outer selector is operable between an idle state and an active state, wherein the outer selector is in physical contact with the user interface at least in the active state.

6. The laundry appliance of claim 5, wherein the outer selector includes an aperture through which the user interface is accessible for defining the active state.

7. The laundry appliance of claim 6, wherein the outer selector includes at least one intermediary interface that extends through the aperture.

8. The laundry appliance of claim 7, wherein the at least one intermediary interface is laterally operable within the aperture and selectively engages a pressure-sensitive switch of the user interface.

9. The laundry appliance of claim 8, wherein the outer selector includes a knob that is rotationally operable relative to the user interface, wherein rotation of the knob defines a corresponding lateral movement of the at least one intermediary interface.

10. The laundry appliance of claim 7, wherein the at least one intermediary interface is a plunger that is coupled with a handle of the outer panel.

11. The laundry appliance of claim 6, wherein the aperture is defined between the outer panel and a top panel of a cosmetic outer structure, wherein the top panel is positioned over the body.

12. The laundry appliance of claim 1, wherein the outer selector is at least partially defined by a deflecting portion of the outer panel.

13. A laundry appliance comprising:

a body that houses a motor that selectively operates at least one of a drum and a blower for processing laundry within the drum, wherein the body includes an aperture for selectively accessing the drum;

a door panel that is attached to the body and provides selective access to the aperture;

a user interface in communication with a controller for selecting a laundry-processing function to be performed via operation of the motor;

a cosmetic outer structure that selectively conceals the door panel and the user interface from view, the cosmetic outer structure including an operable outer panel and a top panel; and an outer selector positioned on the operable outer panel and aligned with the user interface, wherein the outer selector is in communication with the controller via selective physical communication with the user interface.

14. The laundry appliance of claim 13, wherein the outer selector is defined by a handle of the cosmetic outer structure, and wherein the user interface includes a pressure-sensitive switch that receives a portion of the handle.

15. The laundry appliance of claim 13, wherein the outer selector includes a sliding gap selector that is positioned within a gap defined between the top panel and the operable outer panel of the cosmetic outer structure, and wherein the sliding gap selector includes a plurality of gap selectors that correspond to a motor start function, a motor stop function and a motor pause function, respectively.

16. The laundry appliance of claim 13, wherein the outer selector is at least partially defined by a deflecting portion of the operable outer panel, wherein the deflecting portion includes a deflecting insert that is positioned within the operable outer panel, wherein the deflecting insert is made of a different material than a remainder of the operable outer panel.

* * * * *